US008289258B2

(12) United States Patent
Song et al.

(10) Patent No.: US 8,289,258 B2
(45) Date of Patent: Oct. 16, 2012

(54) LIQUID CRYSTAL DISPLAY

(75) Inventors: Hong Sung Song, Gyeongsangbuk-do (KR); Woong Ki Min, Daegu (KR); Byung Jin Choi, Gyeongsangbuk-do (KR); Dong Hoon Cha, Gyeongsangbuk-do (KR); Su Hyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1321 days.

(21) Appl. No.: 12/003,584

(22) Filed: Dec. 28, 2007

(65) Prior Publication Data

US 2008/0225036 A1 Sep. 18, 2008

(30) Foreign Application Priority Data

| | | |
|---|---|---|
| Mar. 16, 2007 | (KR) | 10-2007-0026070 |
| Mar. 28, 2007 | (KR) | 10-2007-0030323 |
| Mar. 28, 2007 | (KR) | 10-2007-0030332 |
| Mar. 28, 2007 | (KR) | 10-2007-0030333 |
| Mar. 28, 2007 | (KR) | 10-2007-0030454 |
| May 11, 2007 | (KR) | 10-2007-0046113 |
| May 11, 2007 | (KR) | 10-2007-0046126 |

(51) Int. Cl.
*G09G 3/36* (2006.01)

(52) U.S. Cl. ..... 345/99; 345/213

(58) Field of Classification Search ..... 345/98, 345/99, 100, 213

See application file for complete search history.

(56) References Cited

U.S. PATENT DOCUMENTS

| | | | | |
|---|---|---|---|---|
| 7,030,842 | B2 * | 4/2006 | Ha et al. | 345/76 |
| 7,193,623 | B2 * | 3/2007 | Moon | 345/205 |
| 7,342,634 | B2 * | 3/2008 | Park | 349/151 |
| 2002/0008682 | A1 * | 1/2002 | Park | 345/87 |

FOREIGN PATENT DOCUMENTS

| | | |
|---|---|---|
| CN | 10-2005-0000994 | 1/2005 |
| JP | 2000-194278 | 7/2000 |
| JP | 2001-228834 | 8/2001 |
| JP | 2003-50402 | 2/2003 |

(Continued)

*Primary Examiner* — Yong H Sim

(74) *Attorney, Agent, or Firm* — Morgan, Lewis & Bockius LLP

(57) ABSTRACT

A disclosed display includes a display panel including a first group of data lines and second group of data lines, a plurality of gate lines crossing the first and a second groups of data lines, and a plurality of picture cells arranged in a matrix. The display also includes a first source PCB coupled to first data integrated circuits (ICs) to supply first data voltages to the first group of data lines and a second source PCB coupled to second data ICs to supply second data voltages to the second group of data lines. The display further includes a timing controller having a single output port with a plurality of output pins which are configured to output video data to both the first and second data ICs, and to output a timing control signal to control both the first and second data ICs. In addition, the display includes a first connection cable coupling the single output port of the timing controller to at least one of the first and second source PCBs to transmit the video data and the timing control signal from the timing controller to the at least one of the first and second source PCBs. The first data ICs and second data ICs are configured to generate the first and second data voltages, respectively, based on the video data and the timing control signal.

27 Claims, 35 Drawing Sheets

FOREIGN PATENT DOCUMENTS

| | | | |
|---|---|---|---|
| JP | 2004-133428 | | 4/2004 |
| JP | 2004-146717 | | 5/2004 |
| JP | 2004-354567 | A | 12/2004 |
| JP | 2005-196217 | | 7/2005 |
| JP | 2006-49514 | | 2/2006 |
| KR | 2000-0065858 | A | 11/2000 |
| KR | 2002-0046598 | A | 6/2002 |
| KR | 2003-0058732 | A | 7/2003 |
| KR | 10-2004-0100756 | A | 12/2004 |
| KR | 1020060131317 | A | 12/2006 |

* cited by examiner

LIQUID CRYSTAL DISPLAY

This application claims the benefit of the Korean Patent Application No. P2007-26070 filed on Mar. 16, 2007, Korean Patent Application Nos. P2007-030332, P2007-0030323, P2007-0030333, and P2007-0030454 filed on Mar. 28, 2007, and Korean Patent Application Nos. P2007-0046113 and P2007-0046126 filed on May 11, 2007, each of which is hereby incorporated by reference.

BACKGROUND OF THE INVENTION

1. Field of the Invention

The present invention relates to a liquid crystal display device, and more particularly to a liquid crystal display device that is adapted to simplify a control printed circuit board (PCB).

2. Description of the Related Art

A liquid crystal display (LCD) device controls the light transmittance of liquid crystal cells in accordance with a video signal, thereby displaying a picture. An active matrix type LCD device actively controls data by switching data voltages supplied to liquid crystal cells using a thin film transistor (TFT) formed in each liquid crystal cell Clc, as shown in FIG. 1. Accordingly, it is possible to increase the display quality of the image, such as a motion picture, displayed by the LCD device. In FIG. 1, the reference numeral Cst represents a storage capacitor for maintaining the data voltage charged in the liquid crystal cell Clc. A data voltage is supplied to a data line DL, and a scan voltage is supplied to a gate line GL.

As shown in FIG. 2, a related art LCD device includes a control PCB 20, a source PCB 22, a cable 21 connected between the source PCB 22 and the control PCB 20, and a plurality of source COFs (Chips On Film) 24 connected to the source PCB 22 and the LCD panel 25. A source COF 24 is electrically connected to the source PCB 22 and data pads of the LCD panel 25. On the source COF 24 is mounted a data integrated circuit (hereinafter, referred to as "IC") 23. The control PCB 20 of the LCD device is connected to a system PCB 18 via a wire cable 19.

The system board 18 includes an analog to digital converter, a scaler, and a signal interpolation circuit (not shown). The signal interpolation circuit changes the data supplied through an interface circuit to comply with the resolution of the LCD panel and compensates for the deteriorated video data by the changing the resolution according to a signal interpolation method.

The control PCB 20 is equipped with a control circuit and a data transmitting circuit (not shown). The control PCB 20 supplies the data from the system board 18 via the wire cable 19 to the data ICs 23 of the source PCB 22. Further, it generates the timing control signals for controlling the data ICs 23 and supplies them to the source PCB 22 via the cable 21. Signal lines (not shown) in the source COFs 24 transmit the timing control signals and digital video data from the control PCB 20 to the data ICs 23.

Some of the LCD devices, including for example those made for televisions, have recently been increasing in size. As the LCD panel 25 of the LCD device becomes larger in size, the number of data lines and the number of source COFs 24 increase correspondingly. Moreover, in order to accommodate for more data lines and source COFs, the source PCB 22 becomes larger and more complex. Then, it becomes increasingly difficult to align the source PCB 22 and the source COF 24. Also, as the source PCB 22 becomes larger, it becomes increasingly difficult to couple it to the LCD panel 25 because an automatic mounting device, such as existing SMT (Surface Mount Technology) equipment, is designed on the basis of the source PCB 22 of a relatively small size. Thus, there is a limitation for increasing the size of the source PCB 22 using the existing equipment. Finally, as the LCD device becomes larger, more peripheral components such as memory chips and ICs are required, and the number of required output pins of the control circuit on the control PCB 20 increases. Hence, the cost for manufacturing the control PCB 20 increases.

Moreover, in the related art LCD device configuration as shown in FIG. 2, the control PCB 20 and the system board 18 are manufactured in separate processes. They are coupled through the cable 19, and result in higher manufacturing time and cost. Further, such a configuration has an additional disadvantage in that it tends to make the LCD device thicker.

FIG. 3 shows one potential way to configure large LCD devices. As shown in FIG. 3, the timing controller 131 has dual output ports, and the source PCB is split into two source PCBs 141A and 141B. Each output port of the timing controller 131 is connected to the respective one of the two source PCBs 141A, 141B. However, in this configuration, the timing controller 131 and the control PCB 140 both become larger in size, thereby increasing the cost of the LCD device as well as increasing the overall size of the LCD device for the same size LCD panel.

In the configuration of FIG. 3, the timing controller 131 has two output ports. Then, as shown in FIG. 4, the timing controller 131 includes a left/right data divider 120, a two port expansion part 121 and a data modulator 122. The left/right data divider 120 divides the input digital video data RGB inputted at an input frequency (f) into the left side data RGBl and the right side data RGBr using a frame memory. The data RGBl and RGBr outputted from the left/right data divider 120 are supplied to the two port expansion part 121 at half the input frequency (f/2).

The two port expansion part 121 divides the left/right data RGBl, RGBr inputted at half the frequency (f/2) from the left/right data divider 120 into the odd-numbered pixel data RGBlodd, RGBrodd and the even-numbered pixel data RGBleven, RGBreven. Then, the two port expansion part 121 supplies the data RGBlodd, RGBleven, RGBrodd, and RGBreven to the data modulator 122 at one quarter of the input frequency (f/4).

In the event that the data is modulated by employing the mini LVDS method, the data modulator 122 increases the frequency of the data RGBlodd, RGBrodd, RGBleven, RGBreven from the two port expansion part 121 in accordance with a quadruple speed mini LVDS clock, so as to separately output the left side data RGBlodd, RGBleven and the right side data RGBrodd, RGBreven to two different output ports 141 and 142, respectively, of the timing controller at the same frequency (f) as the input frequency. Each of the left side data RGBlodd, RGBleven and the right side data RGBrodd, RGBreven includes three pairs of odd-numbered pixel data, three pairs of even-numbered pixel data, and a pair of mini clocks. The left side data RGBlodd, RGBleven are transmitted to the first source PCB 141A through the first output port 161 of the timing controller 131, the first connection line 154A and the first FFC (flexible flat cable) 153A. The right side data RGBrodd, RGBreven are transmitted to the second source PCB 141B through the second output port 162 of the timing controller 131, the second connection line 154B and the second FFC 153B. Thus, the number of the output pins of the timing controller 131 needs to be about twice as many as that of a conventional configuration with a single source PCB, causing the timing controller 131 and control PCB 140 to be larger in size and more costly.

SUMMARY OF THE INVENTION

Accordingly, the present invention is directed to a liquid crystal display device that substantially obviates one or more problems due to limitations and disadvantages of the related art.

Accordingly, it is an object of the present invention to provide to a liquid crystal display device that is adaptive for dividing a source PCB into multiple source PCBs and reducing the number of output pins of the timing controller and the size of the control PCB. In this regard, the timing controller is configured to have a fewer number of output ports than the number of source PCBs, e.g., one output port for a device with two source PCBs.

Moreover, it is an object of the present invention to integrate elements and functions of the control PCB into the system board to reduce the size and complexity of the control PCB, and to reduce the overall manufacturing time and cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

In order to achieve these and other objects of the invention, a display according to an aspect of the present invention includes: a display panel including a first group of data lines and a second group of data lines, a plurality of gate lines crossing the first and second groups of data lines, and a plurality of picture cells arranged in a matrix; a first source PCB coupled to first data integrated circuits (ICs) to supply first data voltages to the first group of data lines; a second source PCB coupled to second data ICs to supply second data voltages to the second group of data lines; a timing controller having a single output port with a plurality of output pins which are configured to output video data to both the first and second data ICs, and to output a timing control signal to control both the first and second data ICs; and a first connection cable coupling the single output port of the timing controller to at least one of the first and second source PCBs to transmit the video data and the timing control signal from the timing controller to the at least one of the first and second source PCBs, wherein the first data ICs and second data ICs are configured to generate the first and second data voltages, respectively, based on the video data and the timing control signal.

In another aspect, a liquid crystal display according to the present invention includes: a liquid crystal display panel including a first group of data lines and a second group of data lines, a plurality of gate lines crossing the first and second groups of data lines, a plurality of liquid crystal cells arranged in a matrix, and lines on glass (LOGs); a first source PCB coupled to first data integrated circuits (ICs) to supply first data voltages to the first group of data lines; a second source PCB coupled to second data ICs to supply second data voltages to the second group of data lines; and a timing controller configured to output video data and a timing control signal to the first source PCB, wherein the LOGs couple the first and second source PCBs to transmit the video data and the timing control signal from the first source PCB to the second source PCBs, and wherein the first data ICs and second data ICs are configured to generate the first and second data voltages, respectively, based on the video data and the timing control signal.

In yet another aspect, a liquid crystal display according to the present invention includes: a liquid crystal display panel including a first group of data lines and a second group of data lines, a plurality of gate lines crossing the first and second groups of data lines, and a plurality of liquid crystal cells arranged in a matrix; a first source PCB coupled to first data ICs to supply first data voltages to the first group of data lines; a second source PCB coupled to second data ICs to supply second data voltages to the second group of data lines; and a timing controller configured to output video data to both the first and second data ICs and to output a timing control signal to control both the first and second data ICs, wherein the timing controller is configured to receive an input video data at a first frequency and to output the video data at a second frequency that is substantially higher than the first frequency, and wherein the first data ICs and second data ICs are configured to generate the first and second data voltages, respectively, based on the video data and the timing control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

FIGS. 5 to 16 represent an LCD device according to a first embodiment of the present invention.

Figure 1:
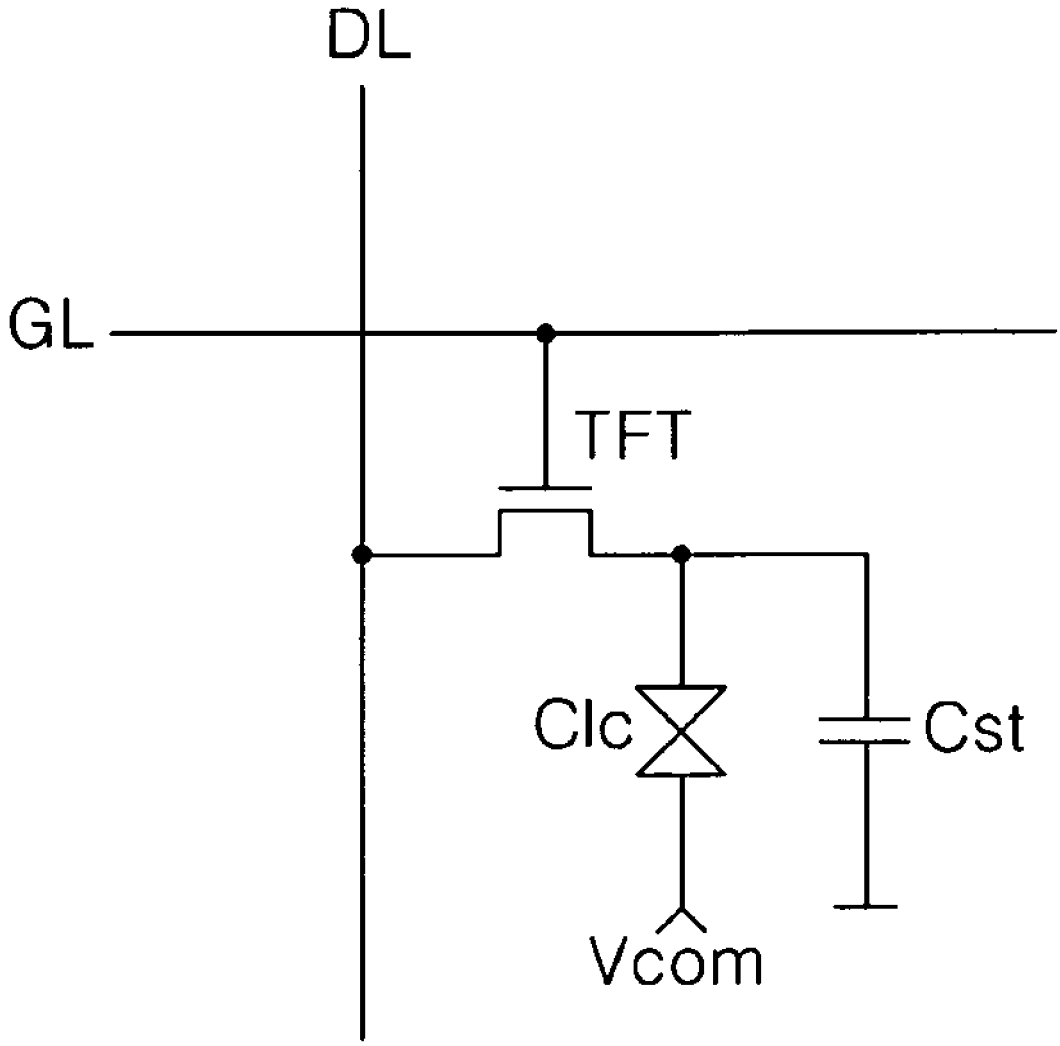
Fig. 1 [RELATED ART]
FIG. 1 is an circuit diagram representing a liquid crystal cell of an LCD device of the related art.
Figure 2:
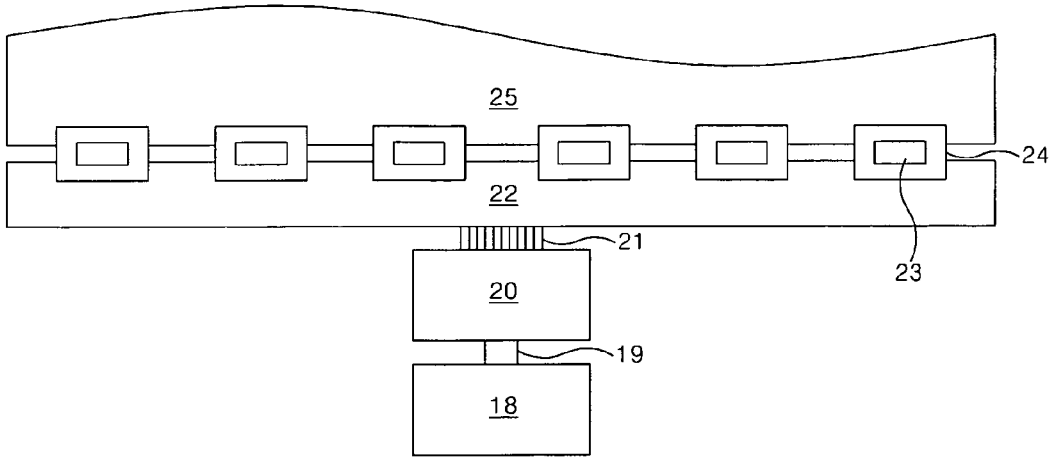
Fig. 2 [RELATED ART]
FIG. 2 is a diagram representing a related art LCD device having a single source PCB.
Figure 3:
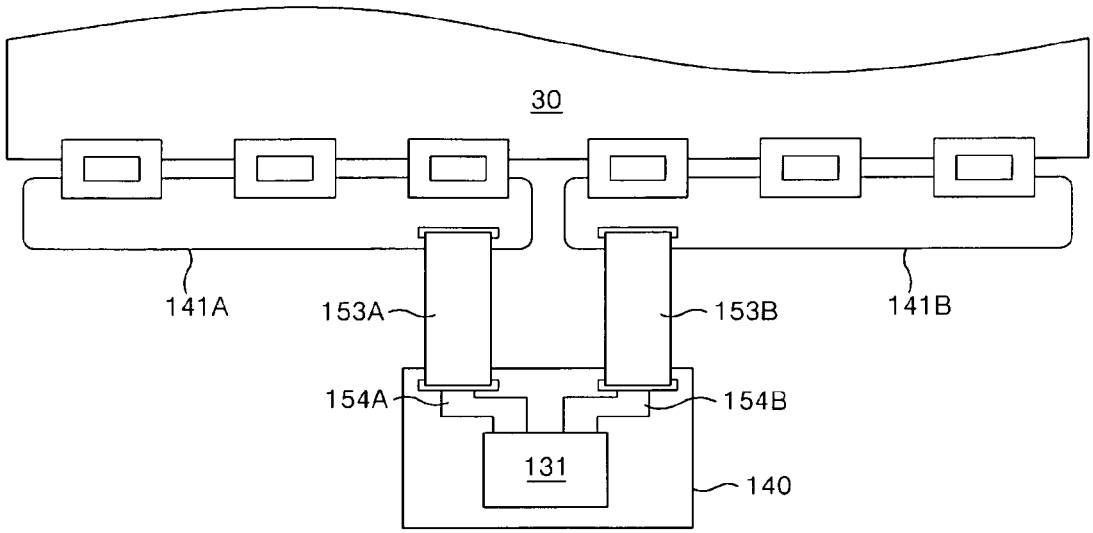
Fig. 3 [RELATED ART]
FIGS. 3 and 4 are diagrams representing a related art configuration with two source PCBs and a timing controller with dual output ports.
Figure 4:
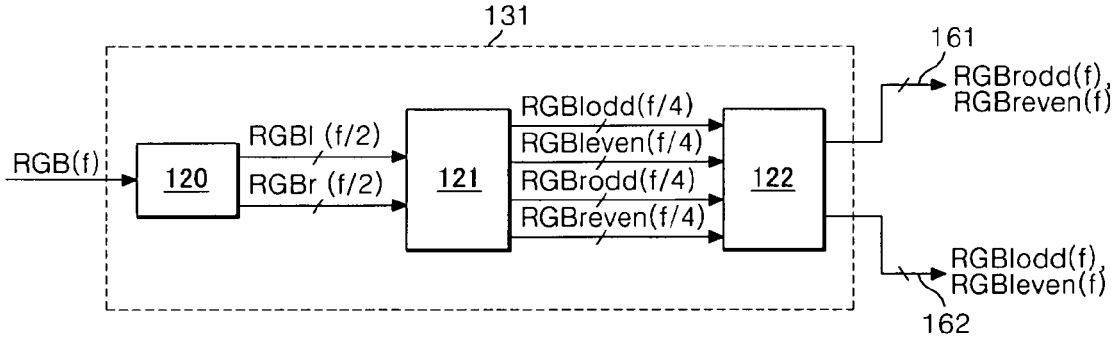
Fig. 4 [RELATED ART]
Figure 5:
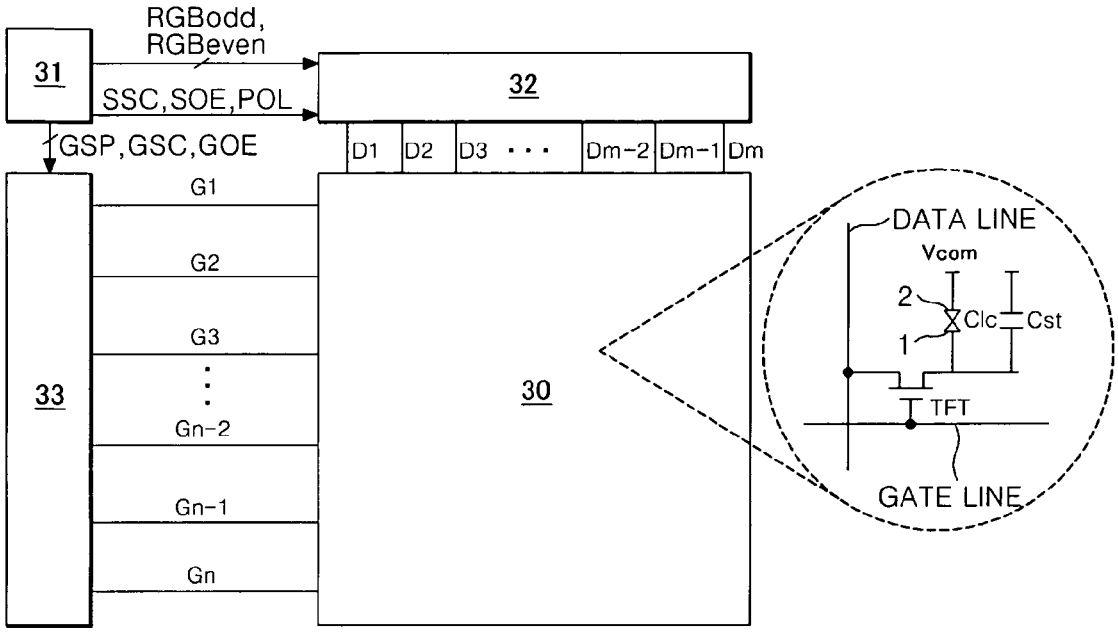
FIGS. 5 and 6 are block diagrams representing an LCD device according to the present invention.

As shown in FIG. 5, the LCD device according to the first embodiment of the present invention includes an LCD panel 30, a timing controller 31, a data drive circuit 32 and a gate drive circuit 33. In the LCD panel 30, a liquid crystal layer is formed between two glass substrates. The LCD panel 30 includes m×n number of liquid crystal cells Clc arranged in a matrix pattern of m number of data lines D1 to Dm and n number of gate lines G1 to Gn.

Formed on the lower glass substrate of the LCD panel 30 are, among others, data lines D1 to Dm, gate lines G1 to Gn, thin film transistors (TFTs), pixel electrodes 1 of liquid crystal cells Clc connected to the TFTs, and storage capacitors Cst. Also formed on the lower glass substrate of the LCD panel 30 are a plurality of LOGs (Lines On Glass) which transmit, among others, data, timing control signals, and drive voltage signals between the source COFs as will be described later.

Formed on the upper glass substrate of the LCD panel 30 are, among others, a black matrix (not shown), color filters (not shown) and a common electrode 2. The common electrode 2 is formed on the upper glass substrate in devices employing a vertical electric field driving method, such as a TN (Twisted Nematic) mode or a VA (Vertical Alignment) mode. Alternatively, the common electrode 2 may be formed along with the pixel electrode 1 on the lower glass substrate in devices employing a horizontal electric field driving method, such as an IPS (In-Plane Switching) mode or an FFS (Fringe Field Switching) mode. Polarizers (not shown) with the optical axes perpendicularly crossing each other are respectively applied to the upper glass substrate and the lower glass substrate of the LCD panel 30. Alignment films (not shown) for setting the pre-tilt angle of liquid crystal molecules are then formed in the internal surfaces of the respective polarizers which face the liquid crystal layer.

Figure 6:
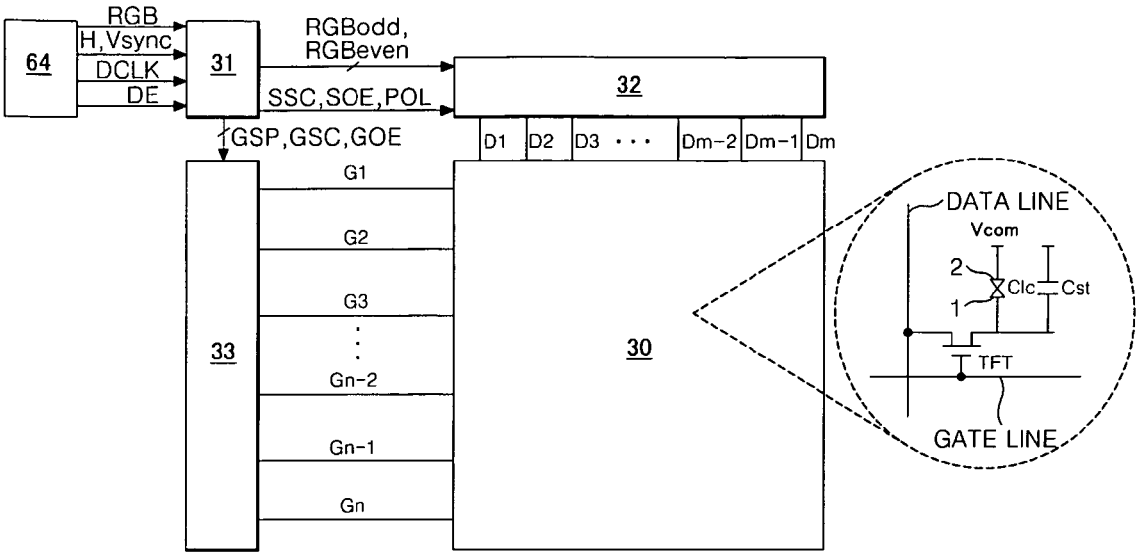

The timing controller 31 receives timing signals such as vertical and horizontal synchronization signals Vsync and Hsync, a data enable signal DE, and clock signals such as a dot clock (DCLK) signal, which comply with the resolution of the LCD panel 30. For example, the timing controller 31 may receive these signals from an image or graphic processing circuit 64 as shown in FIG. 6. The image or graphic processing circuit 64, which may be disposed on the system board, changes the input video data to be compatible with the LCD panel 30. Further, it modulates the video data to control the response characteristics or the contrast of the LCD panel 30, and also generates the above signals Hsync, Vsync, DE, and DCLK input to the timing controller 31. The timing controller 31 receives these signals Hsync, Vsync, DE, and DCLK, and generates timing control signals for controlling the operation timing of the data drive circuit 32 and the gate drive circuit 33.

The timing control signals include gate timing control signals, such as a gate start pulse GSP, a gate shift clock signal GSC, and a gate output enable GOE. The gate start pulse GSP indicates a starting horizontal line from which a scan starts in a first vertical period when an image or data is displayed on the LCD panel 30. The gate shift clock signal GSC is inputted to a shift register within the gate drive circuit and is generated to have a pulse width corresponding to the on-period of the TFT as a timing control signal for sequentially shifting the gate start pulse GSP. The gate output enable signal GOE indicates the output of the gate drive circuit 33.

Further, the timing control signals includes data timing control signals such as a source sampling clock SSC, a source output enable signal SOE, a polarity control signal POL and the like. The source sampling clock SSC indicates a latch operation of the data within the data drive circuit 32 on the basis of a rising or falling edge. The source output enable signal SOE indicates the output of the data drive circuit 32. The polarity control signal POL indicates the polarity of the data voltage which is to be supplied to the liquid crystal cell Clc of the liquid crystal display panel 30.

Further, the timing controller 31 divides digital video data into an odd-numbered pixel data RGBodd and an even-numbered pixel data RGBeven, and supplies the divided data RGBodd, RGBeven to the data drive circuit 32. In order to reduce the swing width of the data voltage and EMI in the transmission path of the data, the timing controller 31 modulates the data by a mini LVDS (low voltage differential signaling) method or an RSDS (reduced swing differential signaling) method, and supplies the modulated data to the data drive circuit 32.

The data drive circuit 32 latches the digital video data RGBodd, RGBeven under control of the timing controller 31. And, the data drive circuit 32 converts the data into an analog positive/negative gamma compensation voltage in accordance with the polarity control signal POL to generate a positive/negative analog data voltage, and supplies the data voltage to the data lines D1 to Dm.

The gate drive circuit 33 is configured to have a plurality of gate ICs (not shown), each of which includes a shift register, a level shifter for converting a swing width of an output signal of the shift register into a swing width which is suitable for driving the TFT of the liquid crystal cell, and an output buffer connected between the level shifter and the gate line G1 to Gn. The gate drive circuit 33 sequentially outputs the scan pulses to the gate lines G1 to Gn. The IC's of the gate drive circuit 33 are mounted on the COF or the TCP to be connected to gate pads (not shown) which are formed on the lower glass substrate of the liquid crystal display panel with an ACF (anisotropic conductive film). Alternatively, the gate drive circuit 33 may be formed directly on the lower glass substrate of the liquid crystal display panel 30 at the same time the TFTs, the gate lines G1 to Gn, and the data lines D1 to Dm are formed in a pixel array with the use of a gate-in-panel process. As a further alternative, the ICs of the gate drive circuit 33 may be directly bonded onto the lower glass substrate of the liquid crystal display panel 30 by a chip-on-glass method.

Figure 7:
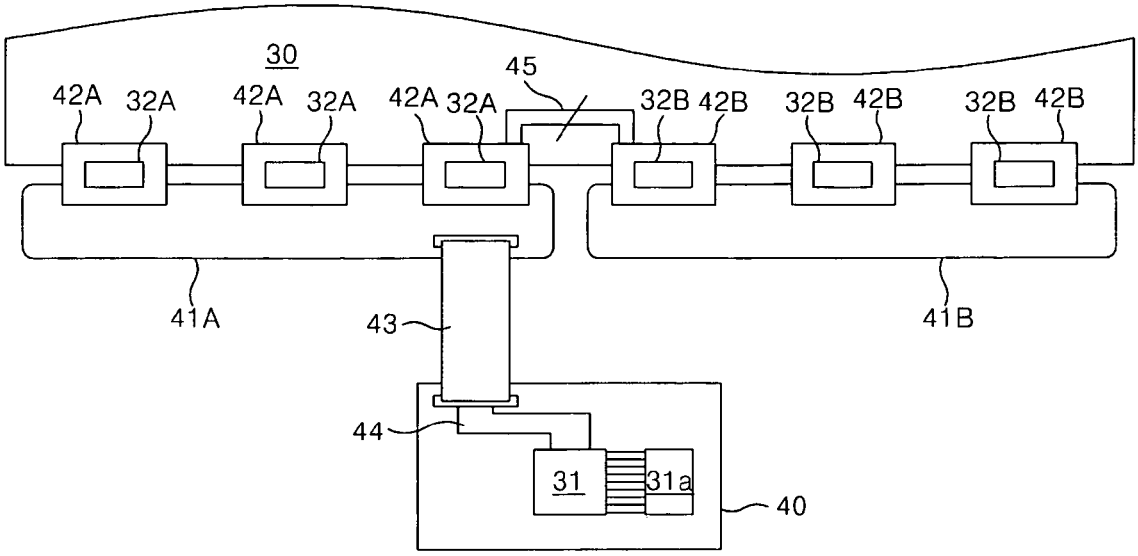
FIG. 7 is a diagram representing a connection configuration of an LCD device according to the first embodiment of the present invention.
Figure 8:
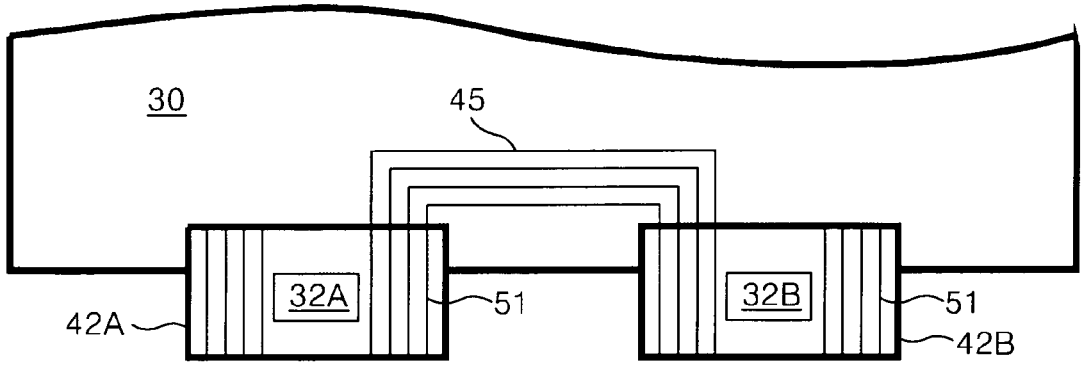
FIG. 8 is a plan view representing dummy lines formed in a source COFs and LOG lines formed on a substrate of an LCD panel.

FIG. 7 is a diagram representing an assembly of a timing controller 31, a data drive circuit 32, and a liquid crystal display panel 30 shown in FIG. 5. FIG. 8 is a diagram representing LOG lines formed on a substrate of the LCD panel 30 and dummy lines formed on source COFs 42A, 42B.

As shown in FIGS. 7 and 8, the data drive circuit 32 includes a plurality of data ICs 32A, 32B. The data ICs 32A, 32B are mounted on the source COFs 42A, 42B, respectively. The source COFs 42A, 42B can be replaced with a source TCPs (tape carrier packages). The source COFs 42A, 42B are respectively connected to first and second source PCBs 41A, 41B. The source COFs 42A for supplying the data to the data lines formed in the right half of the LCD panel 30 are connected to the first source PCB 41A, and the source COFs 42B for supplying the data to the data lines formed in the left half of the LCD panel 30 are connected to the second source PCB 41B. The input terminals of the source COFs 42A, 42B are electrically connected to the output terminals of the source PCBs 41A, 41B, respectively. The output terminals of the source COFs 42 are electrically connected to data pads (not shown) formed on the lower glass substrate of the liquid crystal display panel 30 through the ACF. The data pads are connected to the data lines D1 to Dm through data link lines.

Dummy lines 51, as shown in FIG. 8, are formed in the source COFs 42A, 42B. The dummy lines 51 are supplied with carry signals, data timing control signals, and digital video data RGBodd, RGBeven, which are to be transmitted to the adjacent source COFs 42A, 42B. The dummy lines 51 are also supplied with drive voltages such as high level power supply voltages Vdd, low level power supply voltages Vss, gamma reference voltages, and the like. The dummy lines 51 of the source COF 42A adjacent to the second source PCB 41B and the dummy lines 51 of the source COF 42B adjacent to the first source PCB 41A are electrically connected through the LOG lines 45 formed on the lower glass substrate of the liquid crystal display panel 30.

Formed in the first and second source PCBs 41A, 41B are bus lines to which the digital video data RGBodd, RGBeven are transmitted, bus lines to which the data timing control signals are transmitted, and bus lines to which drive voltages are transmitted.

The input terminals of the first source PCB 41A are electrically connected through an FFC (flexible flat cable) 43 to connection lines 44 formed on the control PCB 40. The second source PCB 41B is not connected to the control PCB 40. The source PCBs 41A, 41B are electrically connected to each other through the LOG lines 45 and through the source COFs 42A, 42B. Accordingly, the first source PCB 41A is supplied with the digital video data RGBodd, RGBeven, the data timing control signals, and the drive voltages from a single output port of the control PCB 40 through the connection lines 44 formed in the control PCB 40. Further, the second source PCB 41B is supplied with the digital video data RGBodd, RGBeven, the carry signal, the data timing control signals, and the drive voltages from the first source PCB 41A through the LOG lines 45 and through the source COFs 42A, 42B.

Provided in the control PCB 40 are a timing controller 31, an EEPROM 31*a*, and connection lines 44. The control PCB 40 may also have a circuit, such as a DC-DC converter (not shown), for generating the drive voltages of the liquid crystal display panel 30. The drive voltages generated in the DC-DC converter include, for example, a gate high voltage Vgh, a gate low voltage Vgl, a common voltage Vcom, a high level power supply voltage Vdd, a low level power supply voltage Vss, and a plurality of gamma reference voltages, which are divided between the high level power supply voltage and the low level power supply voltage. The gamma reference voltages are sub-divided into analog gamma compensation voltages, each of which corresponds to a respective gray level within the data ICs 32A up to the number of gray levels that can be expressed with the number of bits in the digital video data RGBodd, RGBeven. The gate high voltage Vgh and the gate low voltage Vgl represent a swing voltage of the scan pulse. The EEPROM 31*a* stores waveform option information for the timing control signals generated from the timing controller 31 for each mode and supplies the waveform information to the timing controller 31 in the pertinent mode in accordance with an input from a user. The timing controller 31 generates the timing control signals, which are different in each mode, in accordance with the waveform option information from the EEPROM 31*a*.

Figure 9:
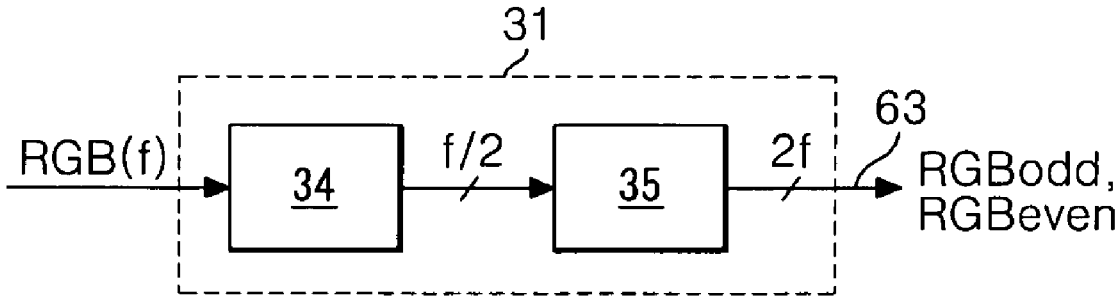
FIG. 9 is a block diagram of the timing controller 31 shown in FIG. 7.

The connection lines 44 formed in the control PCB 40 connect the single output port 63 of the timing controller 31, shown in FIG. 9, to the FFC 43. The digital video data RGBodd, RGBeven and the timing control signals generated from the timing controller 31, and the drive voltages generated from the DC-DC converter are transmitted to the FFC 43 through the connection lines 44.

In the above example, the source PCB is divided into two source PCBs—the first and second source PCBs 41A and 41B. However, the source PCB may be divided into more than two source PCBs, in which case additional sets of LOG lines and dummy lines may be employed.

FIG. 9 is a diagram representing a data processor of the timing controller 31. As shown in FIG. 9, the timing controller 31 includes a two port expansion part 34 and a data modulator 35.

The two port expansion part 34 divides the digital video data RGB inputted at a given input frequency (f) from a main system board (not shown) into odd-numbered pixel data RGBodd and even-numbered pixel data RGBeven. The two port expansion part 34 supplies the divided data RGBodd, RGBeven to the data modulator 35 at one half of the input frequency (f/2). The frequency is reduced to one half of the input frequency in order to reduce EMI (electromagnetic interference). The swing voltage of the data RGBodd, RGBeven outputted from the two port expansion part 34 is relatively high at a TTL (transistor to transistor) level of about 3.3V.

The data modulator 35 modulates the data RGBodd, RGBeven, for example, by a mini LVDS method. Then, the swing width of the data RGBodd, RGBeven from the two port expansion part 34 is decreased to between about 300 mV and about 600 mV. On the other hand, the frequency of the data is increased to twice the input frequency (2*f*) in accordance with a mini LVDS clock, shown for example in FIG. 10. The signals outputted from the data modulator 35 include three pairs of odd-numbered pixel data RGBodd, three pairs of even-numbered pixel data RGBeven, and a pair of mini clocks (mini LVDS CLK). The pair of pixel data RGBodd, RGBeven include a positive signal (P) and a negative signal (N), as shown for example in FIG. 11. Further, instead of the mini LVDS method, the data modulator 35 may alternatively employ an RSDS method or any other appropriate modulation methods to modulate the data RGBodd, RGBeven received from the two port expansion part 34.

Figure 10:
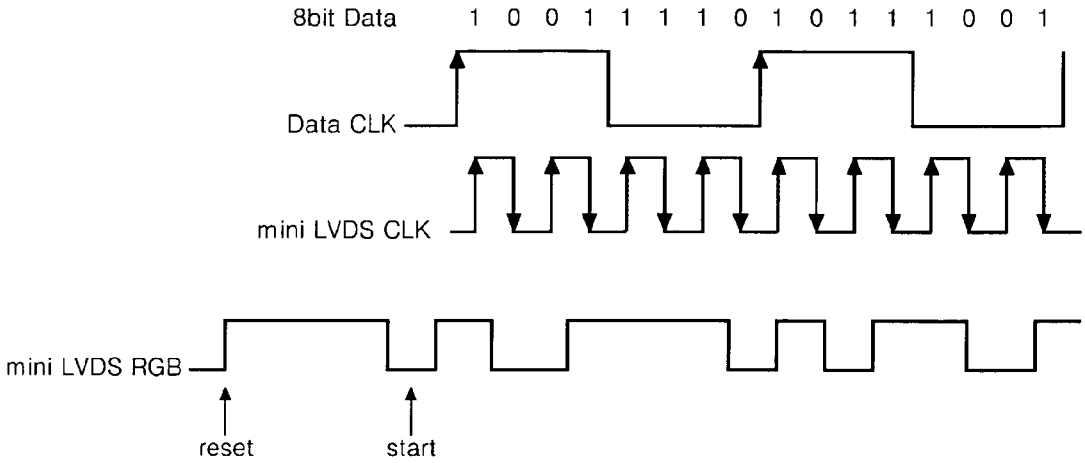
FIGS. 10 and 11 are waveform diagrams of an example data output from the data modulator 35 shown in FIG. 9.
Figure 11:
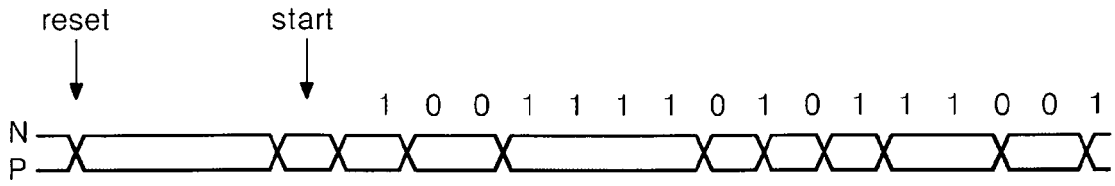

FIGS. 10 and 11 represent an example of the data outputted from the data modulator 35 employing the mini LVDS method. In FIG. 10, Data CLK represents a data clock generated from the main system board, and mini LVDS CLK represents a clock which is generated from the data modulator 35 to be transmitted along with the data. The mini LVDS RGB includes a reset waveform and is a positive data signal (P) waveform, shown in FIG. 11, that are modulated by the data modulator 35.

Figure 12:
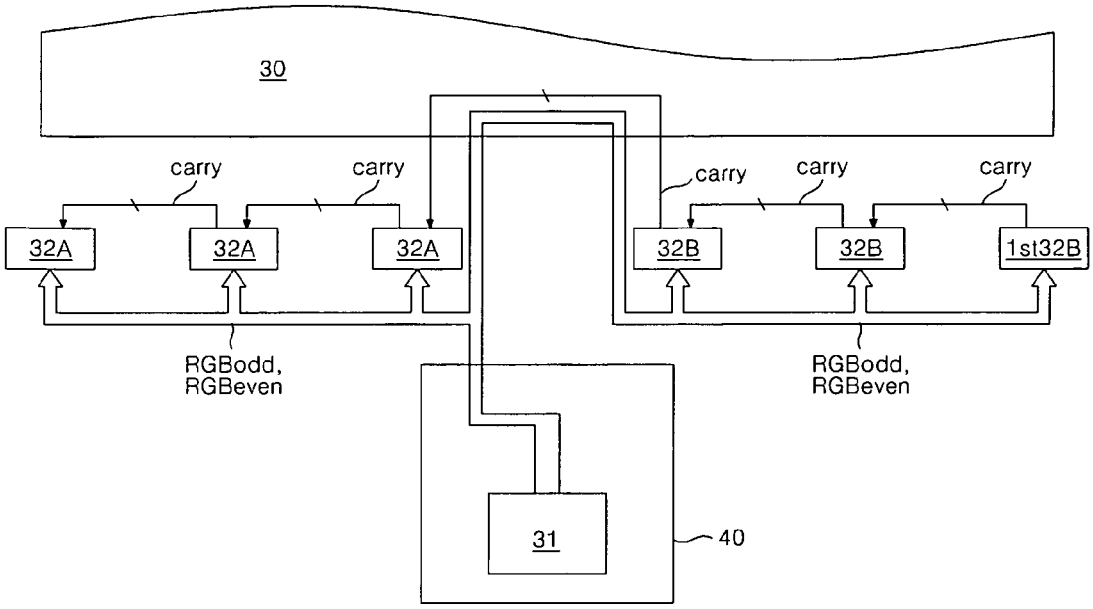
FIG. 12 is a diagram representing an example signal transmission path in the LCD device shown in FIG. 7.

The data modulator 35 generates the negative data signal (N) to be out-of-phase with the positive data signal (P), as shown in FIG. 11. The data modulator 35 generates six pairs of data, each pair including a positive data signal (P), a negative data signal (N), and a pair of mini LVDS clocks. As shown in FIG. 12, the first data IC (1$^{st}$ 32B) for sampling the first data detects a start pulse (shown for example in FIGS. 10 and 11) following a reset waveform (shown for example in FIGS. 10 and 11) as a point in time when the data sampling is to start. The first data IC then starts sampling the data supplied subsequently to the start pulse (start). Accordingly, it is not necessary for the timing controller 31 to generate a separate source start pulse SSP through a separate line.

FIG. 12 represents a signal transmission path between the timing controller 31 and the data ICs 32A, 32B. As shown in FIGS. 7, 9, and 12, the right side digital video data RGBodd, RGBeven modulated by the timing controller 31 are transmitted to the data ICs 32A, connected to the first source PCB 41A, through the single output port 63 of the timing controller 31, the connection lines 44, and the FFC 43. The right side digital video data RGBodd, RGBeven are data to be displayed in a right half of the LCD panel 30. Also, as shown in FIGS. 7-9 and 12, the left side digital video data RGBodd, RGBeven modulated by the timing controller 31 are transmitted to the data ICs 32B, connected to the second source PCB 41B, through the single output port 63 of the timing controller 31, the connection lines 44, the first source PCB 41A, the dummy lines 51 of the source COF 42A, and the LOG lines 45 of the LCD panel 31. The left side data RGBodd, RGBeven are data to be displayed in a left half of the LCD panel 30.

The data timing control signals generated in the timing controller 31 are transmitted together with the digital video data RGBodd, RGBeven to the data ICs 32A, connected to the first source PCB 41A, through the single output port 63 of the timing controller 31, the connection lines 44, and the FFC 43. Further, the data timing control signals are transmitted to the data ICs 32B, connected to the second source PCB 41B, through the single output port 63 of the timing controller 31, the connection lines 44, the first source PCB 41A, the dummy lines 51 of the source COF 42, and the LOG lines 45 of the LCD panel 30.

After sampling the data subsequent to the start pulse the number of times substantially equal to the number of its own output channels, as shown in FIGS. 10 and 11, the left most first data IC (1$^{st}$ 32B) for sampling the first data generates a carry signal, which indicates the sampling timing of the next data, and supplies the carry signal to the adjacent data IC 32B. In the same manner, the carry signal is sequentially transmitted to the adjacent data ICs 32A, 32B, as shown in FIG. 12. The carry signal between the first and second source PCBs 41A, 41B is transmitted through the LOG line 45 formed in the LCD panel 30. Alternatively, the data sampling direction of the data ICs 32A, 32B can be reversed. In this case, the carry signal between the first and second source PCBs 41A, 41B is transmitted in a reverse direction.

The drive voltages generated from the DC-DC converter (not shown) mounted on the control PCB 40 are transmitted to the data ICs 32A, connected to the first source PCB 41A, through the output terminal of the DC-DC converter, the connection lines 44, and the FFC 43. Further, the drive voltages are transmitted to the data ICs 32B, connected to the second source PCB 41B, through the output terminal of the DC-DC converter, the connection lines 44, the first source PCB 41A, the dummy lines 51 of the source COF 42A, and the LOG lines 45 of the LCD panel 30.

Figure 13:
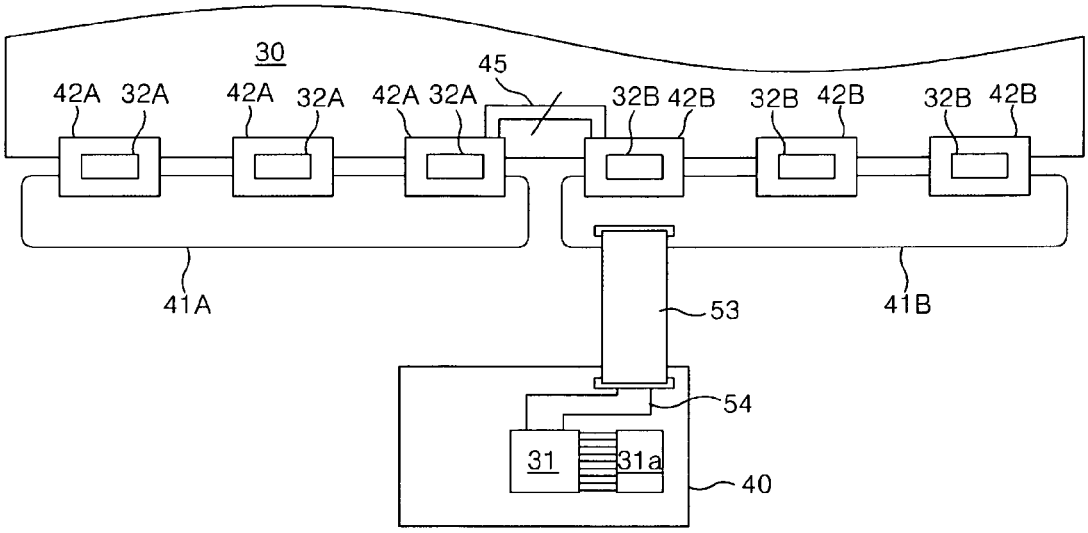
FIG. 13 is a block diagram representing an alternative configuration of the LCD device according to the first embodiment of the present invention.

FIG. 13 represents an alternative configuration of the LCD device according to the first embodiment of the present invention. As shown in FIG. 13, the second source PCB 41B is electrically connected to the connection lines 54 formed on the control PCB 40 through the FFC 53. The first source PCB 41A and the data COFs 42A connected thereto are not connected directly to the control PCB 40. Instead, the first source PCB 41A and the data COFs 42A are supplied with the data timing control signals and the drive voltages through the connection lines 54, the FFC 53, the second source PCB 41B, the dummy lines 51 of the source COF 42B, and the LOG lines 45. The first source PCB 41A and the data COFs 42A are also supplied with the carry signal through the LOG lines 45.

Figure 14:
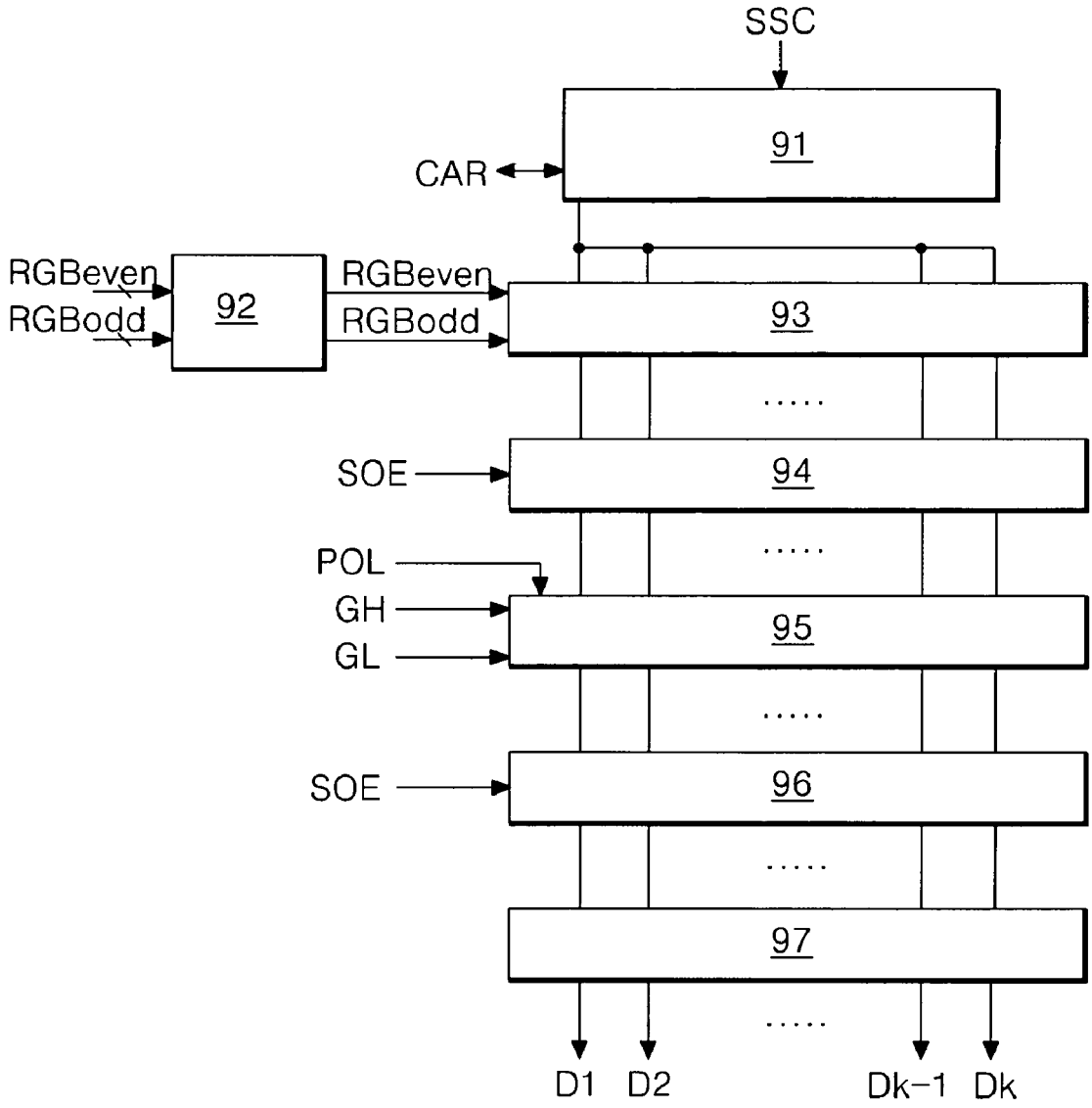
FIG. 14 is a block diagram of a data IC 32A or 32B shown, for example, in FIG. 7.
Figure 15:
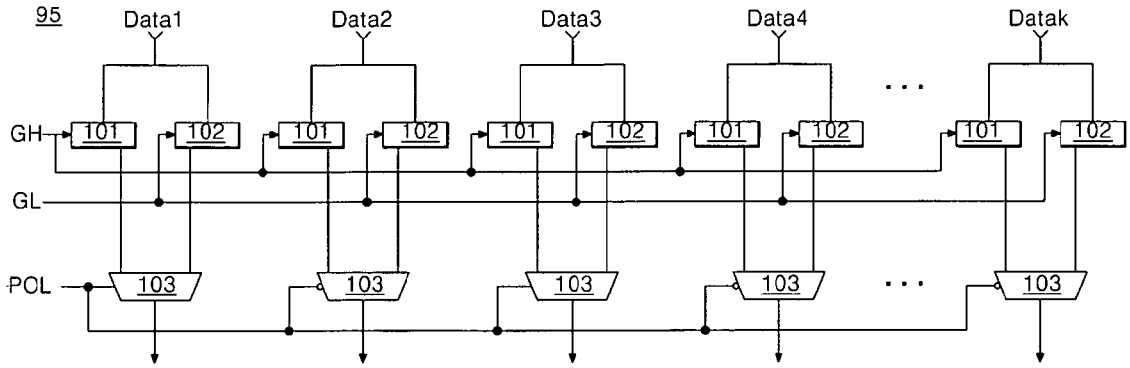
FIG. 15 is a circuit diagram of the digital to analog converter 95 shown, for example, in FIG. 14.

FIGS. 14 and 15 are circuit diagrams representing each of the data ICs 32A, 32B in more detail. As shown in FIGS. 14 and 15, each of the data ICs 32A, 32B includes a shift register 91, a data restoring part 92, a first latch array 93, a second latch array 94, a digital/analog converter (hereinafter, referred to as "DAC") 95, a charge share circuit 96, and an output circuit 97.

The data restoring part 92 temporarily stores the odd-numbered pixel data RGBodd and the even-numbered pixel data RGBeven, which are divided by the timing controller 31. The data storing part 92 restores the data by demodulating the data RGBodd, RGBeven received from the timing controller 31 by employing a demodulation method corresponding to the modulation method employed by the data modulator 35 of the timing controller 31. For example, the data restoring part 92 generates '1' when the positive data is at a high logic level and '0' when the positive data is at a low logic level, as shown in FIG. 11. And, the data restoring part 92 supplies the restored data RGBodd, RGBeven to the first latch array 93.

The shift register 91 shifts the sampling signal in accordance with the source sampling clock SSC. Further, the shift register 91 generates the carry signal when being supplied with the data with bits exceeding the number of latches of the first latch array 93. The shift register 91 of the first data IC (1$^{st}$ 32B) for sampling the first data detects the data supplied subsequently to the start pulse and the reset signal as the first data to be sampled.

The first latch array 93 samples the restored digital video data RGBeven, RGBodd from the data restoring part 92 in response to the sampling signals sequentially inputted from the shift register 91. The first latch array 93 latches the data RGBeven, RGBodd for pixels in one horizontal line and then simultaneously outputs the latched data.

The second latch array 94 latches the data inputted from the first latch array 93 and then outputs the latched digital video data RGBeven, RGBodd substantially simultaneously as the second latch array 94 of the other data ICs 32A for a logic low period of the source output enable signal SOE.

As shown in FIG. 15, the DAC 95 includes a P-decoder PDEC 101 to which a positive gamma compensation voltage GH is supplied, an N-decoder NDEC 102 to which a negative gamma compensation voltage GL is supplied, and a multiplexer 103 which selects from the output of the P-decoder 101 and the output of N-decoder 102 based on the polarity control signal POL. The P-decoder 101 decodes the digital video data RGBeven, RGBodd inputted from the second latch array 94 to output the positive gamma compensation voltage GH corresponding to the gray level value of the digital video data. The N-decoder 102 decodes the digital video data RGBeven, RGBodd inputted from the second latch array 94 to output the negative gamma compensation voltage GL corresponding to the gray level value of the digital video data. The multiplexer 103 selects either the positive gamma compensation voltage GH or the negative gamma compensation voltage GL based on the polarity control signal POL.

The charge share circuit 96 shorts the adjacent data output channels for the logic high period of the source output enable signal SOE to output an average value of the adjacent data voltages as a charge share voltage, or supplies the common voltage Vcom to the data output channels for the logic high period of the source output enable signal SOE, thereby reducing a rapid change of the positive and negative data voltages. The output circuit 97 includes a buffer and minimizes a signal attenuation of the analog data voltages supplied to the data line D1 to Dk.

Figure 16:
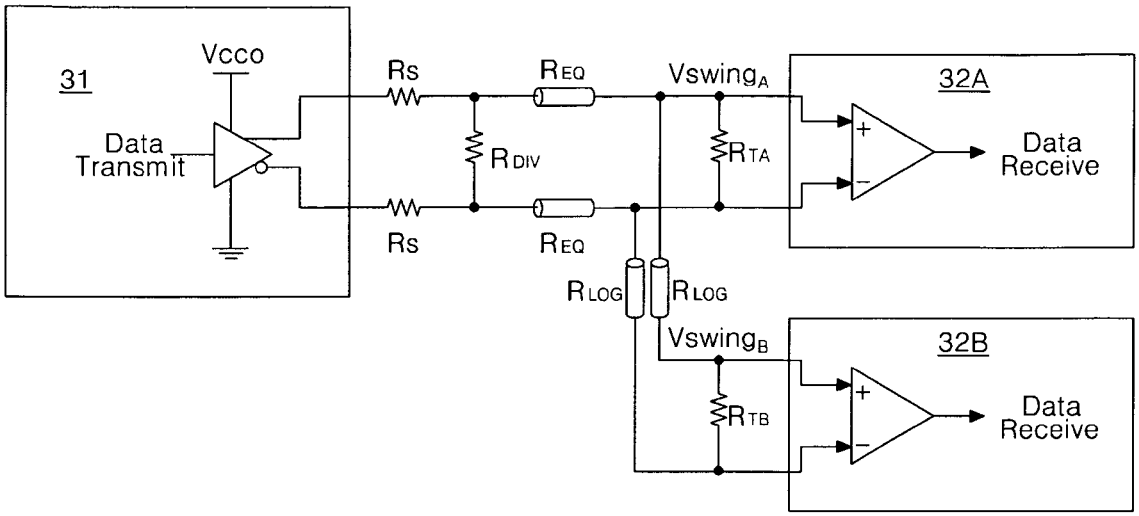
FIG. 16 is a representative circuit diagram of the timing controller 31, first data IC 32A, and second data IC 32B as shown for example in FIG. 7, and the connections among them.

FIG. 16 equivalently represents the timing controller 31 shown in FIG. 7, the data IC 32A connected to the first source PCB 41A, the data IC 32B connected to the second PCB 41B, and resistors Rs, $R_{DIV}$, $R_{EQ}$, $R_{LOG}$, $R_{TA}$, $R_{TB}$. Each of the clock signals and the data outputted from the timing controller 31 includes the positive signal (P) and the negative signal (N). The positive signal output terminal and negative signal output terminal of the timing controller 31 are each connected to a corresponding resistor Rs. Further, the resistor $R_{DIV}$ is connected between the positive signal output terminal and the negative signal output terminal of the timing controller 31. The resistors $R_{TA}$, $R_{TB}$ are connected between the positive signal input terminal and the negative signal input terminal of the data ICs 32A, 32B, respectively. The resistors Rs, $R_{DIV}$, $R_{TA}$, $R_{TB}$ synchronize the phase of the positive signal (P) and the phase of the negative signal (N), and adjust their voltages to be between about 300 mV and about 600 mV. The resister $R_{EQ}$ equivalently represents the line resistance on the signal transmission line between a serial resistor Rs and the data IC 32A connected to the first source PCB 41A and on the signal transmission line between the serial resistor Rs and the LOG line 45, and also includes the resistance on the FFC 43 and on the connection line 44 formed in the control PCB 40.

As can be seen in FIG. 16, the data, carry signal, and drive voltages supplied to the data IC 32B connected to the second PCB 41B each have a reduced voltage due to the line resistance $R_{LOG}$ of the LOG lines 45. Accordingly, the voltages of the signals supplied to the data IC 32B connected to the second source PCB 41B are lower in comparison with the voltages of the same signals supplied to the data IC 32A connected to the first source PCB 41A.

In order to compensate for the line resistance $R_{LOG}$ on the LOG lines 45, the LCD device according to the first embodiment of the present invention determines the resistance value of the resistors $R_{TA}$, $R_{TB}$, which are connected between the positive and negative input terminals of the data ICs 32A, 32B, respectively, as detailed below.

The voltage ($Vswing_A$) of the mini LVDS signal supplied to the data IC 32A, which is not affected by the line resistance $R_{LOG}$ on the LOG lines 45, is as follows:

$$Vswing_A=((R_{DIV}/2)/((R_{DIV}/2)+R_{DRIVER}+R_S))\times((R_{TB}/2)/((R_{TB}/2)+R_{EQ}))\times Vcco. \quad \text{[Mathematical Formula 1]}$$

The voltage ($Vswing_B$) of the mini LVDS signal supplied to the data IC 32B, which is affected by the line resistance $R_{LOG}$ on the LOG lines 45, is as follows:

$$Vswing_B=((R_{DIV}/2)/((R_{DIV}/2)+R_{DRIVER}+R_S))\times((R_{TA}/2)/((R_{TA}/2)+R_{EQ}+R_{LOG}))\times Vcco. \quad \text{[Mathematical Formula 2]}$$

In Mathematical Formulas 1 and 2, $R_{DRIVER}$ represents an internal resistance within the timing controller 31, and Vcco represents a data transmission drive voltage of the timing controller 31.

In order to avoid the potential deviation between the mini LVDS signal input voltages supplied to the data IC 32A and data IC 32B, the mini LVDS signal input voltage $Vswing_A$, which is not affected by the resistance $R_{LOG}$, should be the same as the mini LVDS signal input voltage $Vswing_B$, which is affected by the resistance $R_{LOG}$, as follows:

$$Vswing_A=Vswing_B=(R_{TB}/(R_{TB}+2R_{EQ}))=(R_{TA}/(R_{TA}+2R_{EQ}+2R_{LOG})). \quad \text{[Mathematical Formula 3]}$$

Accordingly, the resistor $R_{TA}$ connected between the positive and negative signal input terminals of the data IC 32A connected to the first source PCB 41A is determined to have a resistance value as follows:

$$R_{TA}=(R_{TB}(R_{EQ}+R_{LOG}))/R_{EQ} \quad \text{[Mathematical Formula 4]}$$

In an LCD device according to the second embodiment of the present invention, some of the components and functions of the control PCB in the related art LCD devices are removed from the control PCB and are instead integrated into the system board. Hereinafter, to the extent that the components of the LCD device according to the first embodiment of the present invention are also employed in the LCD device according to the other embodiments of the present invention, such components are given the same reference numerals, and the detailed description of such components provided in connection with the first embodiment above may not be repeated.

Figure 17:
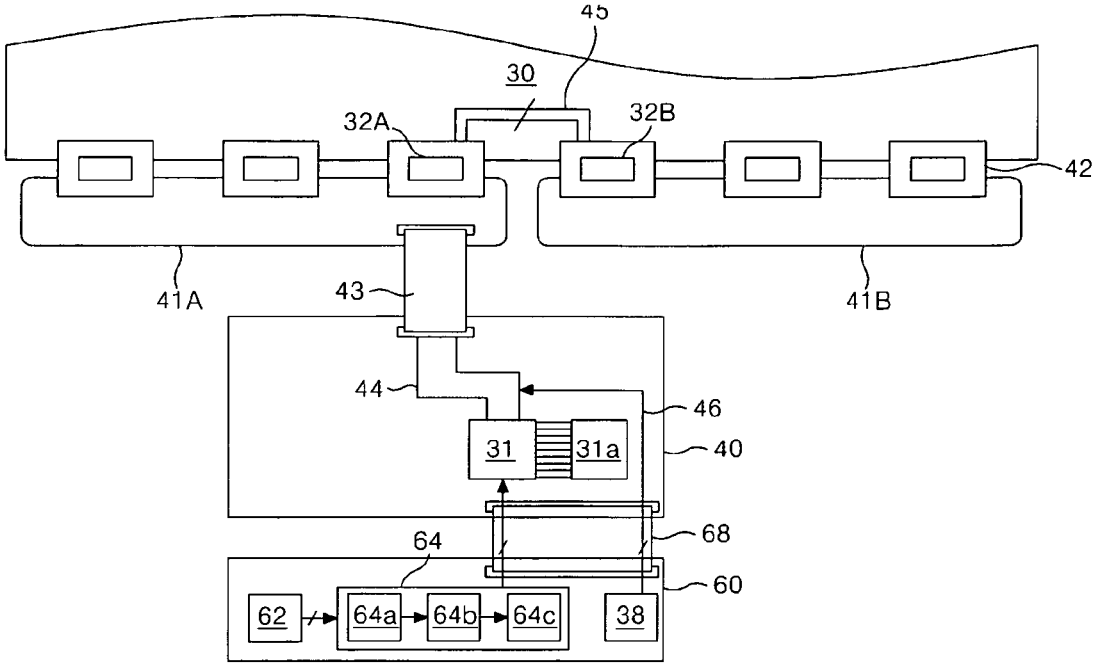
FIG. 17 is a diagram representing a connection configuration of an LCD device according to the second embodiment of the present invention.

As shown in FIG. 17, the system board 60 includes the interface circuit 62 for receiving various video data from the external appliances, the graphic processing circuit 64 for changing the video data from the interface circuit 62 to be compatible with the LCD panel 30, and a DC-DC converter 38 for generating driving voltages to the LCD panel 30.

The interface circuit 62 receives various kinds of video data from such external devices as a DVD player, VCD and HDD, a TV set-top box, and the like and supplies the video data to the graphic processing circuit 64.

The graphic processing circuit 64 includes the analog to digital converter 64*a*, scaler 64*b*, and an image processor 64*c*. The graphic processing circuit 64 converts the video data from the interface circuit 62 to be compatible with the LCD panel 30 and generates the timing signals that are compatible with the resolution of the LCD panel 30 based on the video data. The graphic processing circuit 64 supplies the converted digital video data and the timing signals to the timing controller 31 via the wire cable 68.

The analog to digital converter 64*a* coverts the analog video data supplied from the interface circuit 62 into digital video data. The scaler 64*b* changes the resolution of the digital video data from the analog to digital converter 64*a* to be compatible with the resolution of the LCD panel 30. Further, in order to adjust one or both of the response characteristics and contrast of the LCD panel 30, the scaler 64*b* also modulates the digital video data using a predetermined compensation. To do so, the scaler 64*b* includes one or both of a first modulator for enhancing the response characteristics of the LCD panel 30 and a second modulator for emphasizing the contrast of the LCD panel 30.

Figure 18:
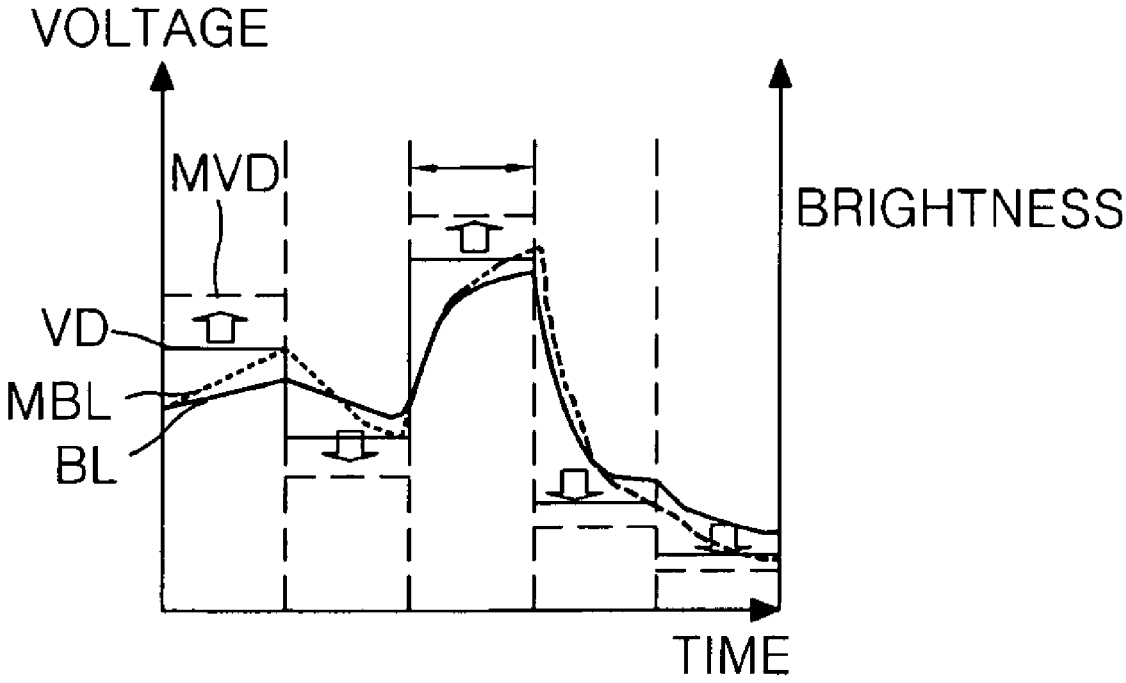
FIG. 18 is a graph showing an example modulation to improve contrast performed by the graphic processing circuit 64 shown in FIG. 17.
Figure 19:
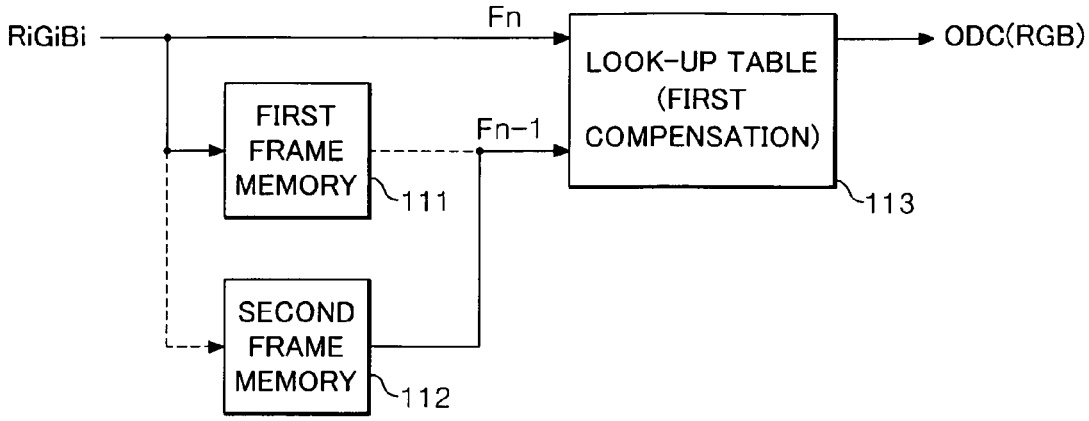
FIG. 19 is a block diagram of an example first modulator in the graphic processing circuit 64 shown in FIG. 17.

The first modulator, as shown for example in FIG. 19, compares the previous frame data with the present frame data. According to the result of the comparison, it determines the variations of data. The first modulator then reads from a memory the first compensation corresponding to the determined variation. Finally, it modulates the digital video data with the first compensation to enhance the response characteristics of the LCD panel 30. For example, the liquid crystal response speed used in the TN (Twisted Nematic) mode may vary according to the nature of liquid crystal and the amount of cell gap. For example, a typical LCD panel uses a rising time of about 20 to 80 ms and a falling time of about 20 to 30 ms. This response time of liquid crystal may be longer than the period for one frame, which is 16.67 ms for NTSC. Therefore, the current frame may be changed to next frame before the voltage charged to a liquid crystal cell reaches the voltage required to operate the liquid crystal correctly. In case of displaying a motion picture on the LCD panel, this may result in a motion burring problem such that the motion picture is not displayed clearly on the LCD panel. Due to the slow response time of the liquid crystal, when data is changed from one voltage level to other voltage level, the brightness of the liquid crystal cell may not reach the next target brightness. To compensate for the slow response time, the first modulator compares the digital video data between the previous frame and the present frame. According to the result of the comparison, it selects one of the predetermined compensation values as the first compensation. Finally, using the selected first compensation, the first modulator modulates the digital video data of the present frame by increasing the absolute voltage value supplied to the LCD panel from VD to MVD, as shown in FIG. 18. To carry out the above procedure, the first modulator may include, for example, two frame memories 111 and 112, and a look-up table 113, as shown in FIG. 19.

The first frame memory 111 and the second frame memory 102 alternate storing the digital video data (RiGiBi) by frame unit and outputting the stored data. As a result, they supply the data Fn−1 for the previous frame, or the (n−1)-th frame, to the look-up table 113. The look-up table 113 is a memory including a number of predetermined first compensation values. The look-up table 113 compares the data Fn for the current frame, or the n-th frame, with the data Fn−1 for the previous or (n−1)-th frame received from the first and second frame memories 111 and 112. The look-up table 113 outputs a first compensation corresponding to the result of the comparison as a modulated digital video data ODC(RGB).

For example, when the digital video data Fn for a given pixel in the present or n-th frame is higher than the digital video data Fn−1 for that pixel in the previous or (n−1)-th frame, the first modulator modulates the digital video data with a larger value than the data Fn for the present frame using one of the predetermined first compensation values. On the other hand, if the digital video data Fn for a given pixel in the present or n-th frame is lower than the digital video data Fn−1 for that pixel in the previous or (n−1)-th frame, the first modulator modulates the digital video data with a smaller value than the data Fn for the present frame. Further, if the data Fn for the present frame is the same as the data Fn−1 for the previous frame, the first modulator outputs the data Fn for the present frame as is without modulating it.

The first modulator may employ any one of the modulating methods described in the Korean Patent Application No. 10-2001-0032364, No. 10-2001-0057119, No. 10-2001-0054123, No. 10-2001-0054124, No. 10-2001-0054125, No. 10-2001-0054127, No. 10-2001-0054128, No. 10-2001-0054327, No. 10-2001-0054889, No. 10-2001-0056235, No. 10-2001-0078449, and No. 10-2002-0046858, which are incorporated herein by reference.

Figure 20:
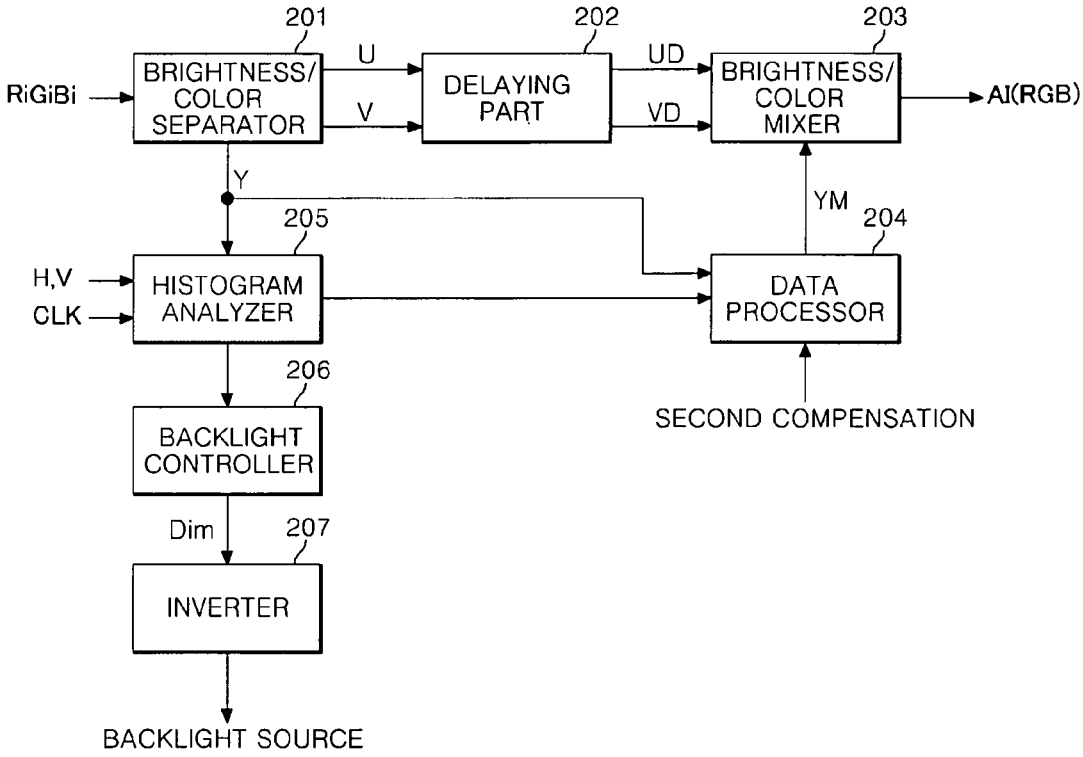
FIG. 20 is a block diagram of an example second modulator in the graphic processing circuit 64 shown in FIG. 17.

The second modulator, as shown for example in FIG. 20, analyzes the brightness of the digital video data RiGiBi. According to the result of the analysis, it modulates the digital video data with one of the second compensations stored in a memory. The second modulator increases the brightness of the digital video data RiGiBi in portions of the LCD panel displaying bright images. On the other hand, the second modulator decreases the brightness of the digital video data RiGiBi in portions of the LCD panel displaying dark images, thereby improving the contrast. The second compensations are determined by a data stretching curve (or a data gamma compensation curve) for enhancing the brightness and contrast of each gray scale range. For example, the second modulator modulates the digital video data RiGiBi using the second compensations determined by a data stretching curve. The data stretching curve has a steeper slope for a gray scale range in the gray distribution graph within which a relatively high number of digital video data RiGiBi fall and has a gentler slope for a gray scale range within which a relatively smaller number of digital video data RiGiBi fall. At the same time, based on the brightness analysis, the second modulator controls the brightness of the backlight unit to increase the brightness in the brighter portion of the displayed video image and to decrease the brightness in the darker portion of the displayed video image. In other words, according to the result of the brightness analysis on the digital video data RiGiBi, the second modulator modulates the brightness of the digital video data RiGiBi and controls the brightness of the backlight to enhance the contrast of the displayed image. As a result, the second modulator increases the dynamic contrast ratio in the display video data, particularly when a motion picture is displayed.

To perform the above procedure, the second modulator may, for example, includes a brightness/color separator 201, a delaying part 202, a brightness/color mixer 203, a histogram analyzer 205, a data processor 204, a back light controller 206, and an inverter 207, as shown in FIG. 20. The brightness/color separator 201 separates the digital video data RiGiBi into the brightness component Y and color components U and V.

Figure 21:
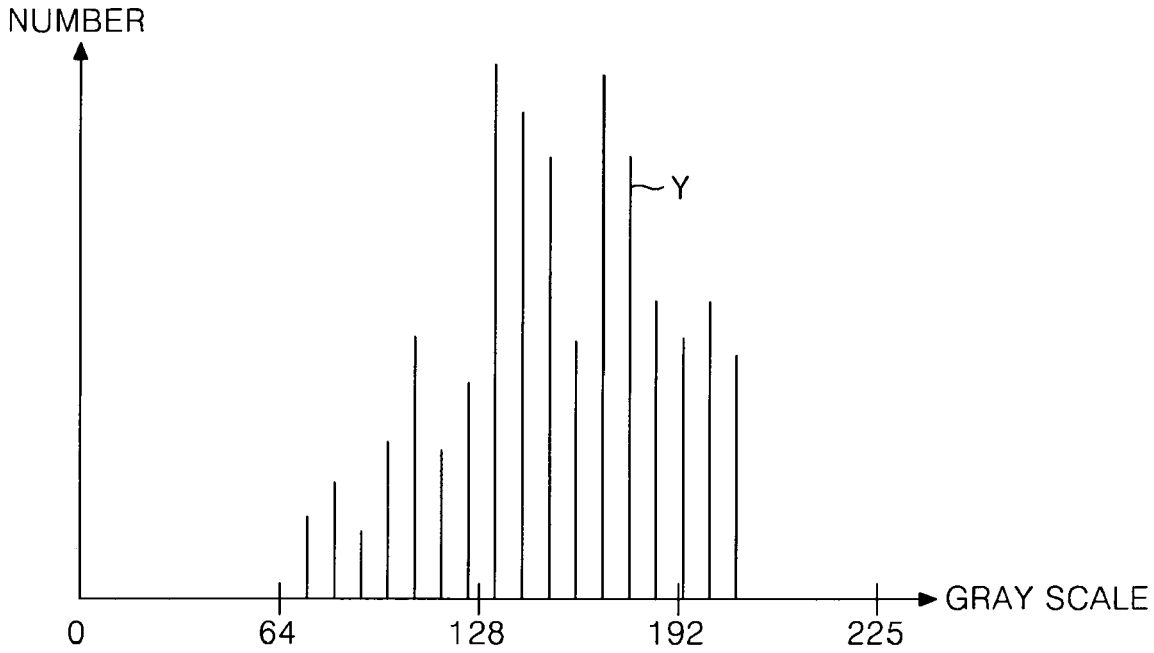
FIG. 21 is an example gray scale distribution graph employed by the histogram analyzer 205 shown in FIG. 20.

The histogram analyzer 205 receives the brightness component Y from the brightness/color separator 201, counts the number of each gray scale in the video data and makes a histogram with an accumulated distribution graph, as shown in FIG. 21. The histogram analyzer 205 determines the position of digital video data RiGiBi in the histogram using the horizontal and vertical sync signals Hsync and Vsync, and clock signal CLK.

The data processor 204 selectively modulates the brightness component Y of the input video data based on the result of the histogram analysis from the histogram analyzer 205 and the second compensation from the memory. The data processor 204 then outputs modulated brightness component YM, whose contrast is selectively emphasized.

The delaying part 202 delays the color components U and V until the modulated brightness component YM is generated by the data processor 204 to synchronize the delayed color components UD and VD with the modulated brightness component YM in order to have them input to the brightness/color mixer 203 substantially at the same time. Based on the modulated brightness component YM and the delayed color components UD and VD, the brightness/color mixer 203 calculates and outputs the modulated digital video data AI(RGB).

The backlight controller 206 receives the results of the histogram analysis and the determined position of the digital video data RiGiBi on the histogram from the histogram analyzer 205. Based on the information received from the histogram analyzer 205, the back light controller 206 generates various dimming control signals Dim to control the brightness of the backlight which radiates light to the LCD panel displaying the modulated digital video data AI(RGB), whose contrast has been emphasized as described above.

The inverter 207 receives the dimming control signal Dim from the backlight controller 206. Based on the dimming control signal, the inverter 207 then separately controls the duty ratio of the driving AC power supplied to each light source of the backlight unit, thereby separately controlling the brightness of each individual light source in accordance with the brightness of the video data RiGiBi.

The second modulator may employ any one of modulating methods described in the Korean Patent Applications No. 10-2003-0099334, No. 10-2004-0030334, No. 10-2003-0041127, No. 10-2004-0078112, No. 10-2003-0099330, No. 10-2004-0115740, No. 10-2004-0049637, No. 10-2003-0040127, No. 10-2003-0081171, No. 10-2004-0030335, No. 10-2004-0049305, No. 10-2003-0081174, No. 10-2003-0081175, No. 10-2003-0081172, No. 10-2003-0080177, No. 10-2003-0081173, and No. 10-2004-0030336, which are incorporated herein by reference.

The image processor 64*c*, shown in FIG. 17, compensates for any degradation in the quality of the input digital video data by enhancing the resolution of the video data, e.g., by employing a signal interpolation method. Further, the image processor 64*c* generates timing signals, such as the sync signals (Hsync and Vsync), data enable signal (DE), and dot clock (DCLK) corresponding with the resolution of the LCD panel 30.

The DC-DC converter 38 generates driving voltages required to drive the LCD panel 30. The driving voltages generated at the DC-DC converter 38 include a gate high voltage (Vgh), a gate low voltage (Vgl), a common voltage (Vcom), a high-level power voltage (Vdd), a low-level power voltage (Vss), and a plurality of gamma reference voltages between the high-level power voltage (Vdd) and the low-level power voltage (Vss). The gamma reference voltages are divided within the data ICs 32A and 32B according to the number of gray scales that can be provided with the number of bits in the digital video data (RGBodd and RGBeven). Accordingly, the gamma voltages are subdivided into analog gamma compensation voltages, each of which corresponds to a respective gray scale. The gate high voltage (Vgh) and the gate low voltage (Vgl) represent a swing voltage of the scanning pulse. These driving voltages are supplied to the signal wires 46 on the control PCB 40 via the wire cable 68.

The driving voltages generated from the DC-DC converter 38 mounted on the system board 60 are then transmitted to the first data ICs 32A connected to the first source PCB 41A via the one-port linking lines 44 and the FFC 43. Also, the driving voltages are transmitted to the second data ICs 32B connected to the second PCB 41B via the first source PCB 41A, the dummy lines 51 of the source COF 42A, and the LOG lines 45 of the LCD panel 30 (see, e.g., FIG. 8).

As described above, in the second embodiment of the present invention, some elements of the control PCB in the related art LCD device are integrated into the system board. For example, in the second embodiment of the present invention, the system board 60 includes a graphics processing circuit that modulates the digital video data with a predetermined compensation in order to adjust one or both of the response characteristics and contrast of the LCD panel 30. The system board 60 also includes the DC-to-DC converter 38 that generates driving voltages required to drive the LCD panel 30. Therefore, the LCD device according to the second embodiment of the present invention has a control PCB with a significantly reduced size.

Figure 22:
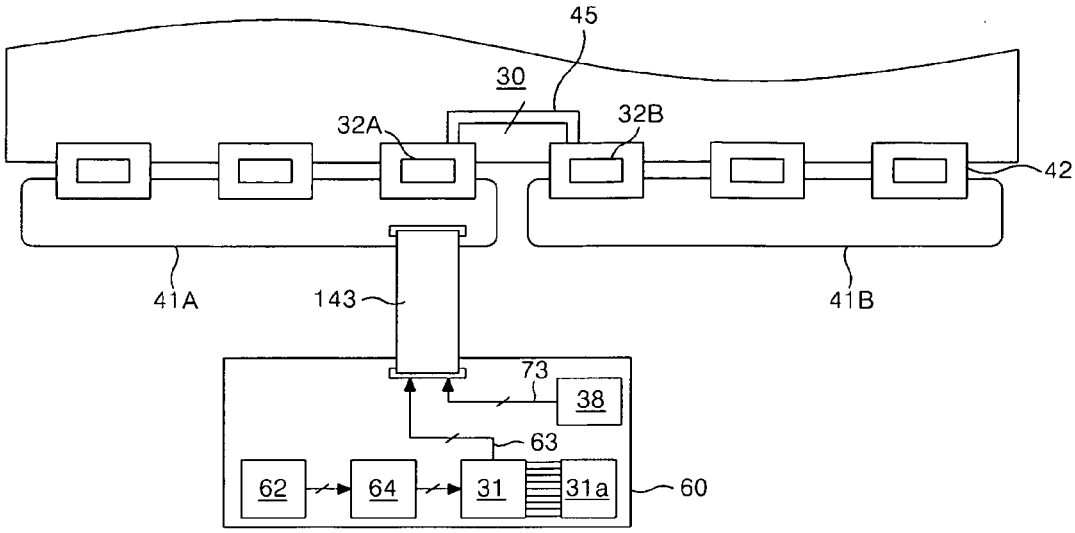
FIG. 22 is a diagram representing a connection configuration of an LCD device according to the third embodiment of the present invention.

In the third embodiment of the present invention, all of the elements of the control PCB in the related art device are integrated into the system board 60. As shown in FIG. 22, the system board 60 includes circuits such as the timing controller 31, an EEPROM 31*a*, and a DC-DC converter 38 that generates driving voltages for driving the LCD panel 30. The system board 60 also includes the interface circuit 62 for receiving various video data from the external appliances. Further, the system board 60 includes the graphic processing circuit 64 having an analog to digital converter, a scaler for changing the resolution of input video data to be compatible with the resolution of the LCD panel 30, and an image processing circuit for signal interpolation and image processing. Accordingly, in the third embodiment of the present invention, the control PCB and the system board in the related art device are integrated into a single system board 60. Therefore, the LCD device according to the third embodiment of the present invention can remove the wire cable used for linking the control PCB and the system board in the related art device. As a result, the cost of manufacturing the LCD device is reduced, and the manufacturing time is shortened. Further, the thickness of the LCD device is reduced.

The detailed description of the elements of the integrated system board 60, shown in FIG. 22, is provided above in connection with the first and second embodiments and is not repeated. The FFC 143 electrically connects the system board 60 to the first source PCB 41A. The FFC 143 transmits the digital video data RGBodd, RGBeven, the timing control signals generated by the timing controller 31, and the driving voltages generated by the DC-DC converter 38 to the data ICs 32A of the first source PCB 41A.

Figure 23:
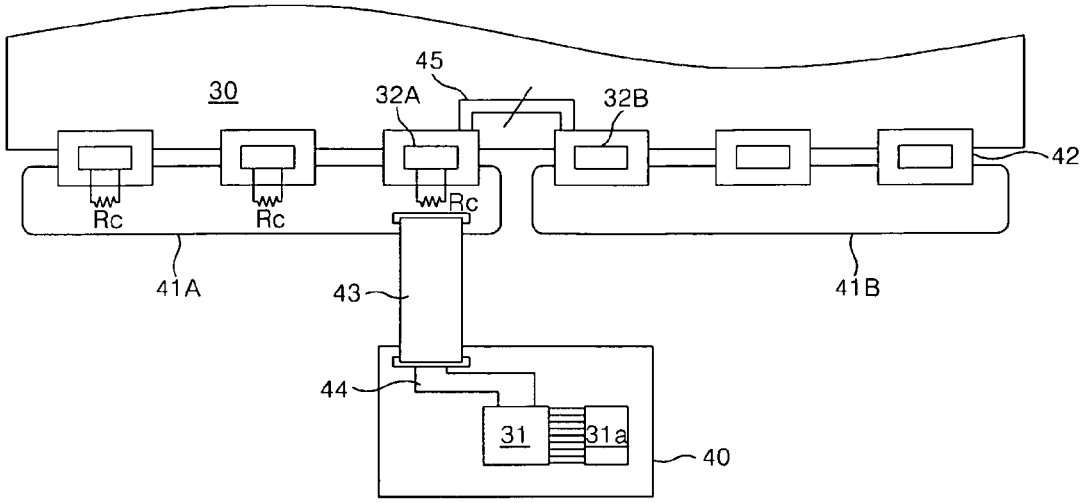
FIG. 23 is a diagram representing a connection configuration of an LCD device according to the fourth embodiment of the present invention.
Figure 24:
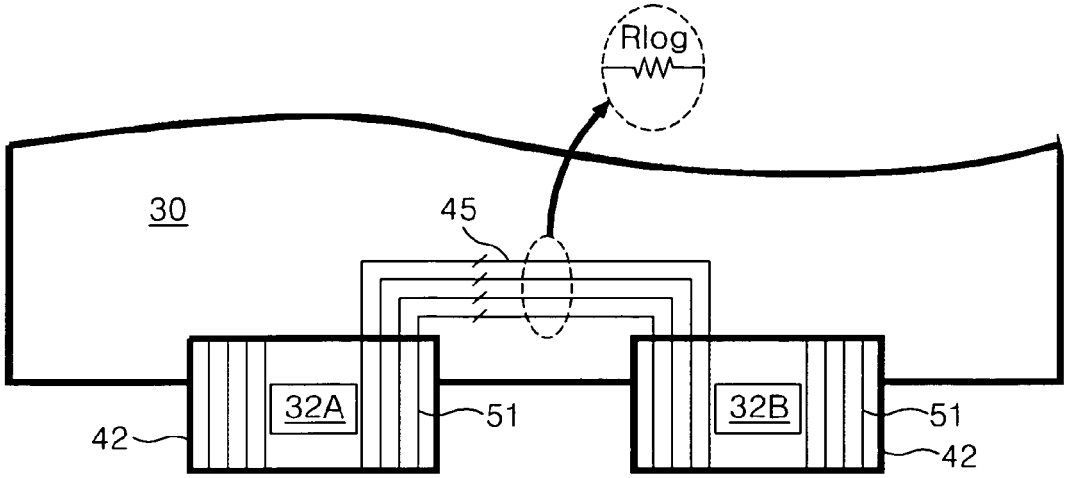
FIG. 24 is a plan view showing dummy lines formed in source COFs and LOG lines formed on a substrate of an LCD panel.

FIGS. 23 to 26 represent an LCD device thereof according to the fourth embodiment of the present invention. FIG. 23 is a diagram representing, in detail, a connection structure of data ICs and a timing controller of a LCD device according to the fourth embodiment of the present invention. FIG. 24 is a diagram representing dummy lines 51 formed in source COFs 32A, 32B, and LOG lines 45 formed on a substrate of the LCD panel 30.

The LCD device according to the fourth embodiment of the present invention employs compensation resistors Rc as shown in FIG. 23. The LOG lines 45 have a relatively high line resistance, and the sum of the line resistance can be represented as resistor Rlog, as shown in FIG. 24. Due to this line resistance Rlog, the amplitudes of the drive voltages supplied from the second source PCB 41B are smaller than the amplitudes of the corresponding drive voltages supplied from the first source PCB 41A. To compensate for this difference in the corresponding drive voltages, the compensation resistors Rc are connected to the first data ICs 32A mounted on the source COFs 42 connected to the first source PCB 41A to reduce the amplitude of the drive voltages supplied from the first source PCB 41A so that they are substantially the same as the amplitudes of the corresponding drive voltages supplied from the second source PCB 41B. Thus, the compensation resistors Rc reduce the amplitudes of the drive voltages supplied to the data ICs 32A connected to the first PCB 41A so that they are substantially the same as the amplitudes of the corresponding drive voltage supplied to the data ICs 32B connected to the second PCB 41B.

Figure 25:
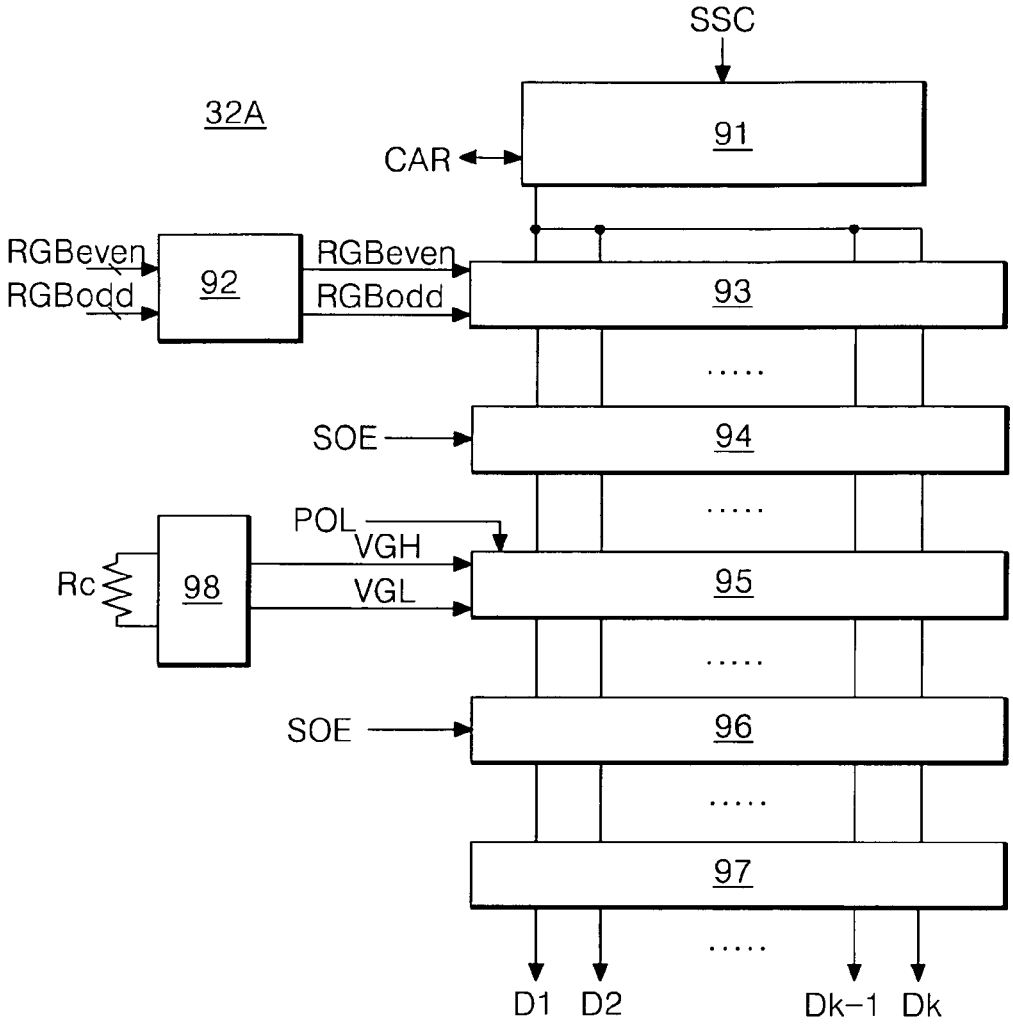
FIG. 25 is a block diagram of a data IC 32A shown in FIG. 23.
Figure 26:
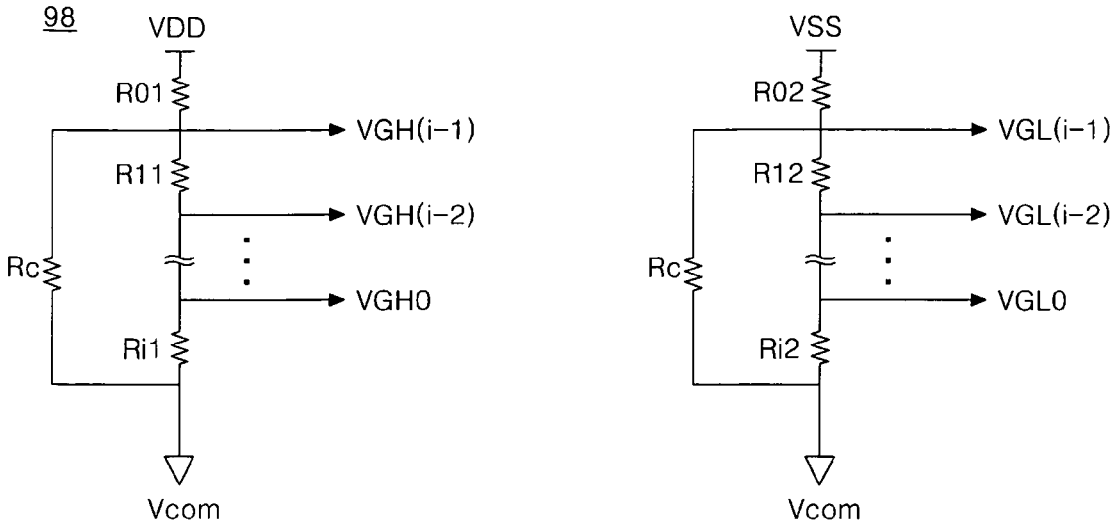
FIG. 26 is a circuit diagram representing a gamma compensation voltage generator 98 shown in FIG. 25.

FIGS. 25 and 26 are circuit diagrams representing the first data IC 32A in more detail. As shown in FIG. 25, each of the data ICs 32A includes a shift register 91, a data restoring part 92, a first latch array 93, a second latch array 94, a digital-to-analog converter (hereinafter, referred to as "DAC") 95, a charge share circuit 96, an output circuit 97, and a gamma compensation voltage generator 98. The compensation resistor Rc is coupled to the gamma compensation voltage generator 98.

As shown in FIG. 26, the gamma compensation voltage generator 98 further divides a plurality of gamma reference voltages, which are divided between the high level power supply voltage Vdd and the common voltage Vcom, and between the low level power supply Vss and the common voltage Vcom. Accordingly, the gamma compensation voltage generator 28 generates as many gamma compensation voltages as the number i of gray levels that can be obtained with the number of bits in the digital video data RGBodd, RGBeven. As shown in FIG. 26, the gamma compensation voltage generator 98 generates positive gamma compensation voltages VGH0 to VGH(i−1) and negative gamma compensation voltages VGL0 to VGL(i−1) corresponding to each gray level. To generate the gamma compensation voltages, the gamma compensation voltage generator 98 includes a resistor string having resistors R01 to Ri1 connected serially between the high level power supply voltage Vdd and the common voltage Vcom, and a resistor string having resistors R02 to Ri2 connected serially between the low level power supply voltage Vss and the common voltage Vcom. The compensation resistors Rc are respectively connected to the resistor strings in parallel to reduce the amplitudes of the positive gamma compensation voltages VGH0 to VGH(i−1) and of the negative gamma compensation voltages VGL0 to VGL(i−1). The compensation resistors Rc are connected in parallel to the resistor strings in each first data IC 32A connected to the first source PCB 41A. The resistance values of the compensation resistors Rc are set such that the gamma compensation voltages generated from each first data IC 32A are substantially the same as the corresponding gamma compensation voltages generated from each second data IC 32B for the same gray levels. In other words, the resistance values of the compensation resistors Rc are set to emulate the voltage drop caused by the line resistance Rlog on the LOG lines 45 shown in FIG. 24.

On the other hand, the second data ICs 32B have substantially the same configuration as the first data ICs 32A except for the gamma compensation voltage generator 98. Although not shown in the drawings, the gamma compensation voltage generator of the second data ICs 32B each include voltage dividers having resistor strings and do not include the compensation resistors Rc connected in parallel to the respective resistor strings.

Figure 27:
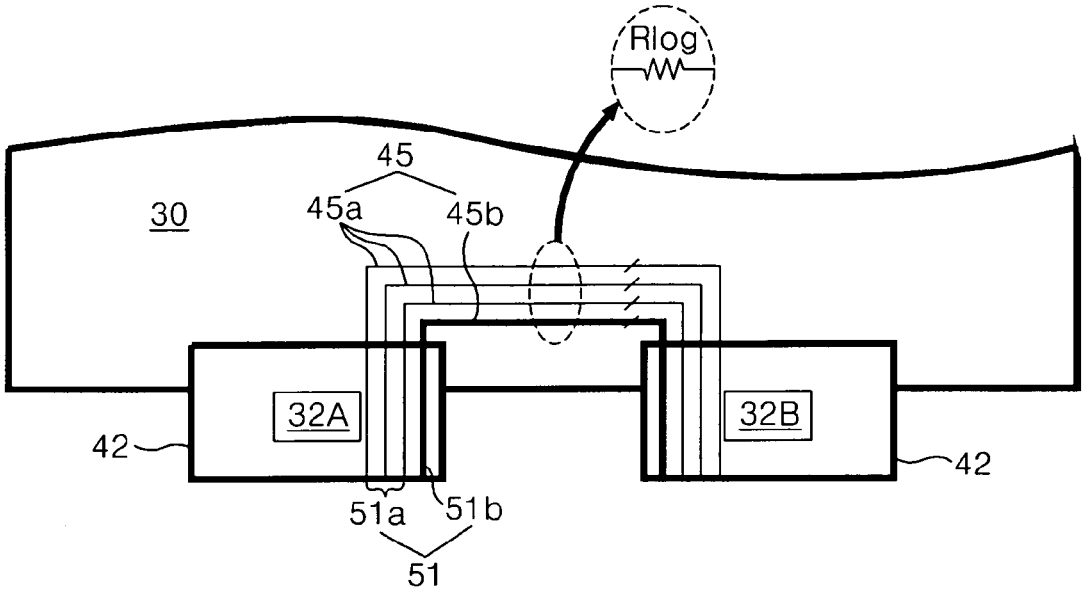
FIG. 27 is a plan view representing dummy lines formed in source COFs and LOG lines formed on a substrate of an LCD panel according to the fifth embodiment of the present invention.

FIG. 27 represents a LCD device according to the fifth embodiment of the present invention. As shown for example in FIG. 27, the data ICs 32A, 32B are mounted on the source COFs 42, respectively. As shown in FIG. 27, dummy lines 51 are formed in the source COF's 42 to transmit data timing control signals and drive voltages. The dummy lines 51 are divided into first dummy lines 51*a* and second dummy lines 51*b*. The first dummy lines 51*a* transmit the data timing control signals including the digital video data RGBodd, RGBeven and the carry signal. The second dummy lines 51*b* transmit the drive voltages, such as a high level power supply voltage Vdd, a low level power supply voltage Vss, the gamma reference voltages, and the like.

The LOG lines 45 are formed on the lower substrate of the LCD panel 30 to couple the source COF 42, coupled to the first source PCB 41A and adjacent to the second source PCB 41B, and the source COF 42, coupled to the second source PCB 41B and adjacent to the first source PCB 41A. The LOG lines 45 transmit between these two source COFs 42 the data timing control signals and drive voltages.

As discussed above, the LOG lines 45 have a relatively high line resistance as described above, and the sum of the line resistance is represented as resistor Rlog in FIG. 27. The voltage drop due to the line resistance Rlog reduce the amplitudes of the drive voltages supplied from the second source PCB 41B so that they are smaller than the amplitudes of the corresponding drive voltages supplied from the first source PCB 41A. This difference in the drive voltages between the first source PCB 41A and second source PCB 41B causes the gamma compensation voltage generators 98 in the second data ICs 32B to generate gamma compensation voltages VGH, VGL that are different from those generated by the gamma compensation voltage generator 98 in the first data ICs for the same digital video data.

In order to prevent or reduce this difference in the gamma compensations voltages, the fifth embodiment of the present invention employs first and second dummy lines 51*a* and 51*b* having different widths. As shown in FIG. 27, the second dummy line 51*b*, which transmit the drive voltages, is wider than the first dummy lines 51*a*, which transmit data timing control signal. In addition, the second LOG line 45*b*, which electrically connects to the second dummy line 51*b*, may also be made wider than the first LOG lines 45*a*, which electrically connect to the first dummy lines 51*a*. The line resistance is proportional to the length of the line and is inversely proportional to the unit area of the line. Accordingly, the increased width of the second dummy line 51*b* reduces the line resistance and reduces the amount of voltage drop over the dummy line 51*b*. The first dummy lines 51*a* transmit the data timing control signals including the digital video data RGBodd, RGBeven and the carry signal, which are not affected by the line resistance on the first LOG lines 45*a* and the resulting voltage drop.

Figure 28:
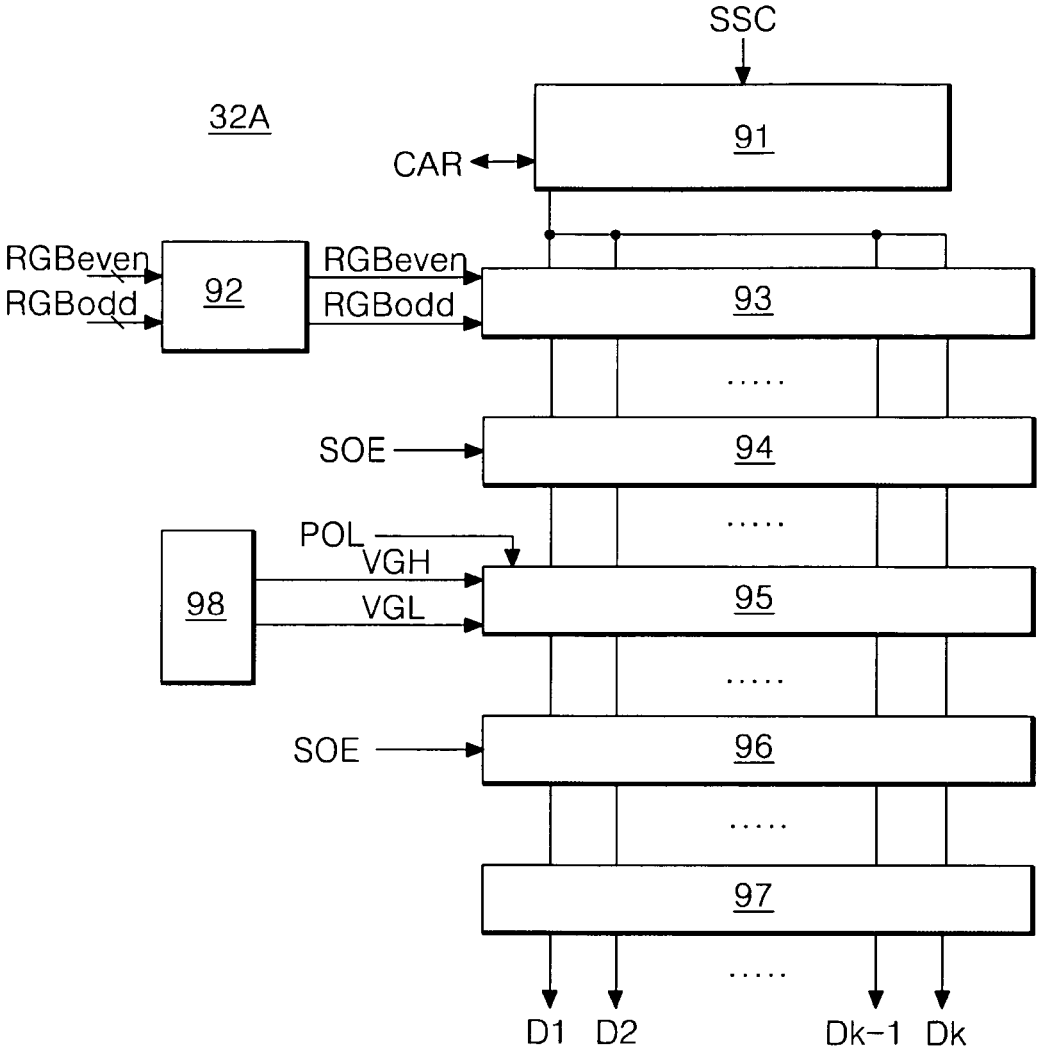
FIG. 28 is a block diagram of a data IC 32A shown for example in FIG. 27.
Figure 29:
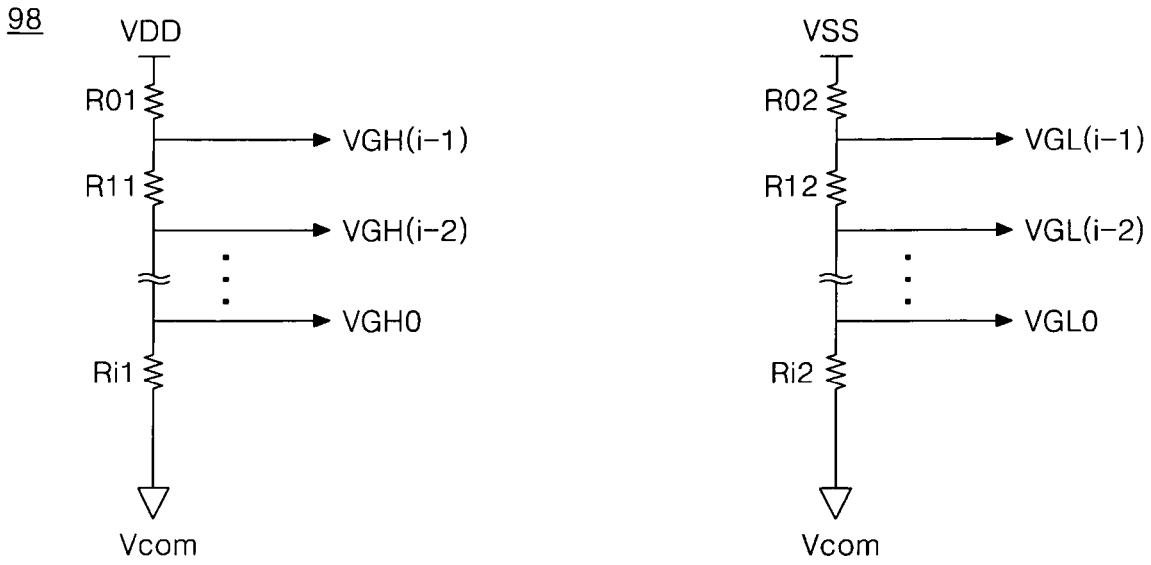
FIG. 29 is a circuit diagram representing a gamma compensation voltage generator 98 shown in FIG. 28.

FIGS. 28 and 29 are circuit diagrams representing the structure of the first data ICs 32A that may be employed in the LCD device according to the fifth embodiment of the present invention, as well as the other embodiments of the present invention. As shown in FIG. 28, each of the first data ICs 32A includes a shift register 91, a data restoring part 92, a first latch array 93, a second latch array 94, a digital-to-analog converter 95, a charge share circuit 96, an output circuit 97, and a gamma compensation voltage generator 98.

As shown in FIG. 29, the gamma compensation voltage generator 98 further divides a plurality of gamma reference voltages, which are divided between the high level power supply voltage Vdd and the common voltage Vcom and between the low level power supply Vss and the common voltage Vcom. Accordingly, the gamma compensation voltage generator 28 generates as many gamma compensation voltages as the number i of gray levels that can be obtained with the number of bits in the digital video data RGBodd, RGBeven. As shown in FIG. 29, the gamma compensation voltage generator 98 generates positive gamma compensation voltages VGH0 to VGH(i−1) and negative gamma compensation voltages VGL0 to VGL(i−1) corresponding to each gray level. To generate the gamma compensation voltages, the gamma compensation voltage generator 98 includes a resistor string having resistors R01 to Ri1 connected serially between the high level power supply voltage Vdd and the common voltage Vcom, and a resistor string having resistors R02 to Ri2 connected serially between the low level power supply voltage Vss and the common voltage Vcom.

Though not separately depicted, the second data ICs 32B may have substantially the same configuration as that of the first data ICs 32A.

Figure 30:
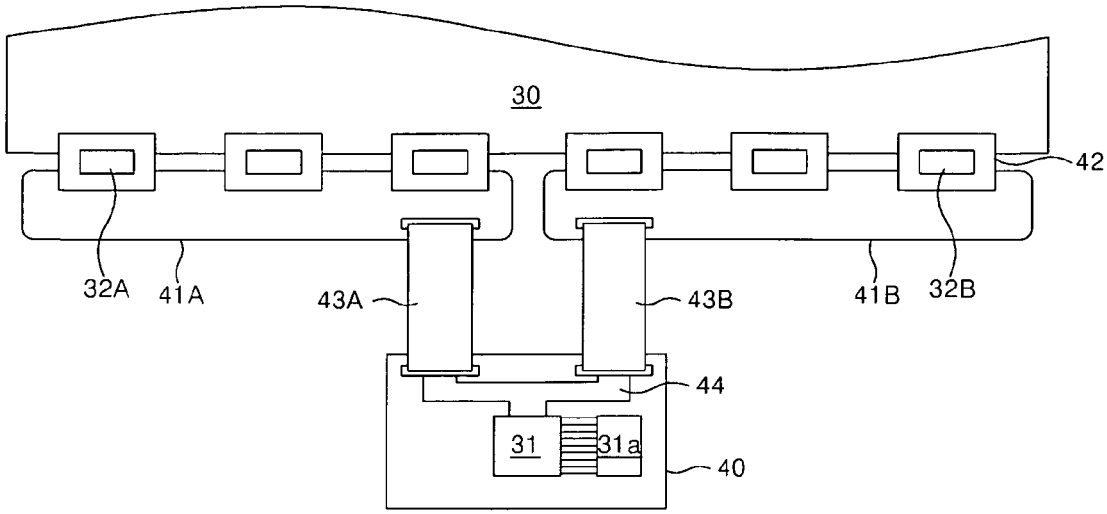
FIG. 30 is a diagram representing a connection configuration of an LCD device according to the sixth embodiment of the present invention.

FIG. 30 is a diagram showing an assembled state of the LCD panel 30, the data driving circuit 32, and the timing controller 31 (see FIG. 5) according to the sixth embodiment of the present invention.

As shown in FIG. 30, the data driving circuit 32 includes a plurality of data ICs 32A, 32B. The plurality of data ICs 32A, 32B are each mounted on a respective source COF 42. The source COFs 42 are connected to first and second source PCBs 41A and 41B, respectively. The input terminals of the source COFs 42 are electrically connected to the output terminals of the first and second source PCBs 41A and 41B, respectively. The output terminals of the source COFs 42 are electrically connected to data pad, which are formed on the lower glass substrate of the LCD panel 30, via an ACF (anisotropic conductive film). The first and second source PCBs 41A and 41B each have bus lines to receive the digital video data RGBodd and RGBeven, bus lines to receive data timing control signals, and bus lines to receive driving voltages.

The input terminals of the first source PCBs 41A are connected to two-port connecting lines 44, which are formed on the control PCB 40, via first FFC 43A. The input terminals of the second source PCBs 41B are connected to the two-port connecting lines 44 via second FFC 43B.

The control PCB 40 includes the two-port connecting lines 44 and such circuits as the timing controller 31, an EEPROM 31*a*, and a DC-DC converter (not shown) that generates driving voltages for the LCD panel 30. The driving voltages generated at the DC-DC converter may include a gate high voltage Vgh, a gate low voltage Vgl, a common voltage Vcom, a high-level power voltage Vdd, a low-level power voltage Vss, and a plurality of gamma reference voltages divided between the high-level power voltage Vdd and the low-level power voltage Vss. The gamma reference voltages are further divided by the data ICs 32A, 32B into analog gamma compensation voltages, each of which corresponds to a gray scale. Thus, the number of generated gamma compensation voltages substantially equals the number of gray scales that can be obtained with the number of bits in the digital video data RGBodd and RGBeven. The gate high voltage Vgh and the gate low voltage Vgl represent a swing voltage of the scanning pulse.

The EEPROM 31*a* stores waveform option information for the timing control signals generated from the timing controller 31 for each mode and supplies the waveform information to the timing controller 31 in the pertinent mode in accordance with an input from a user. The timing controller 31 generates the timing control signals, which are different in each mode, in accordance with the waveform option information from the EEPROM 31*a*.

The two-port connecting lines 44, which are formed on the control PCB 40, are patterned in a "Y" shape to connect a single output port 63 of the timing controller 31 (shown in FIG. 9) with the first and second FFCs 43A and 43B. The timing controller 31 transmits the digital video data RGBodd, RGBeven and the timing control signals to the first and second FFCs 43A and 43B via the two-port connecting lines 44. The DC-DC converter (not shown) on the control PCB 40 supplies the driving voltages to the first and second FFCs 43A and 43B.

Figure 31:
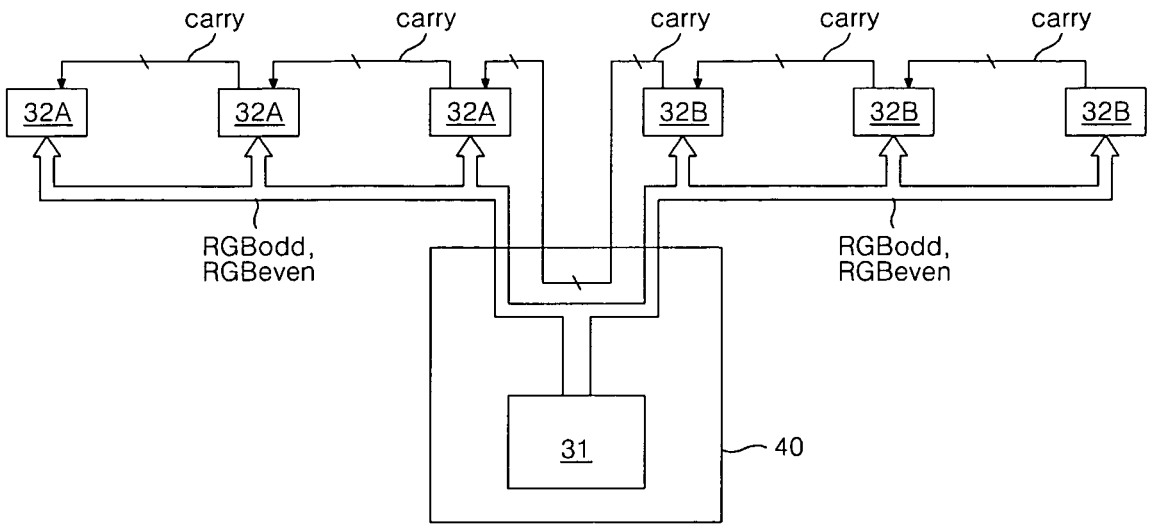
FIG. 31 shows an example signal transmission path in the LCD device shown in FIG. 30.

FIG. 31 shows a signal transmission path between the timing controller 31 and the data ICs 32A, 32B in the LCD device shown in FIG. 30.

As shown in FIG. 31, left data RGBodd, RGBeven, which have been modulated with the mini LVDS method, the RSDS method, or other appropriate methods by the timing controller 31, are transmitted to the first data ICs 32A. The first data ICs 32A are connected to the first source PCB 41A, which in turn is connected to the single output port 63 of the timing controller 31 via the first FFC 43A and the two-port connecting lines 44. If the source COFs 42 are coupled to the data pads at the top edge of the LCD panel 30, the left data RGBodd, RGBeven represent the image to be displayed on the right half of the LCD panel 30. Alternatively, if the source COFs 42 are coupled to the data pads at the bottom edge of the LCD panel, the left data RGBodd, RGBeven represent the image to be displayed on the left half of the LCD panel 30.

On the other hand, right data RGBodd, RGBeven, which are also modulated with the mini LVDS method, the RSDS method, or other appropriate methods by the timing controller 31, are transmitted to the second data ICs 32B. The second data ICs 32B are connected to the second source PCB 41B, which in turn is connected to the single output port 63 of the timing controller 31 via the second FFC 43B and the two-port connecting line 44. If the source COFs 42 are coupled to the data pads at the top edge of the LCD panel 30, the right data RGBodd, RGBeven represent the image to be displayed on the left half of the LCD panel 30. Alternatively, if the source COFs 42 are coupled to the data pads at the bottom edge of the LCD panel, the right data RGBodd, RGBeven represent the image to be displayed on the right half of the LCD panel 30.

The timing control signals generated from the timing controller 31 are also transmitted to the first data ICs 32A, connected to the first source PCB 41A, via the single output port 63 of the timing controller 31 and the first FFC 43A. Also, the timing control signals are transmitted to the second data ICs 32B, connected to the second source PCB 41B, via the single output port 63 of the timing controller 31 and the second FFC 43B.

The rightmost second data IC 32B samples the first data subsequent to the start pulse the number of times substantially equal to the number of its own output channels, as shown for example in FIGS. 10 and 11. The rightmost second data IC 32B then generates a carry signal that indicates a sampling timing of the next data and supplies it to the adjacent second data IC 32B. In the same manner, the carry signal is sequentially transmitted to the adjacent data ICs 32A, 32B. The carry signal is transmitted from the second source PCB 41B to the first source 41A via the second FFC 43B, the two-port connecting lines 44, which is formed on the control PCB 40, and the first FFC 43A. Alternatively, the data sampling direction of the data ICs 32A, 32B may be reversed. In this case, the carry signal is transmitted from the first source PCB 41A to the second source PCB 41B via the first FFC 43A, the two-port connecting line 44, and the second FFC 43B.

The driving voltages from the DC-DC converter (not shown), which may be mounted on the control PCB 40 or the system board, are simultaneously supplied to all data ICs 32A, 32B via the two-port connecting line 44, and the first and second FFCs 43A and 43B, respectively.

Figure 32:
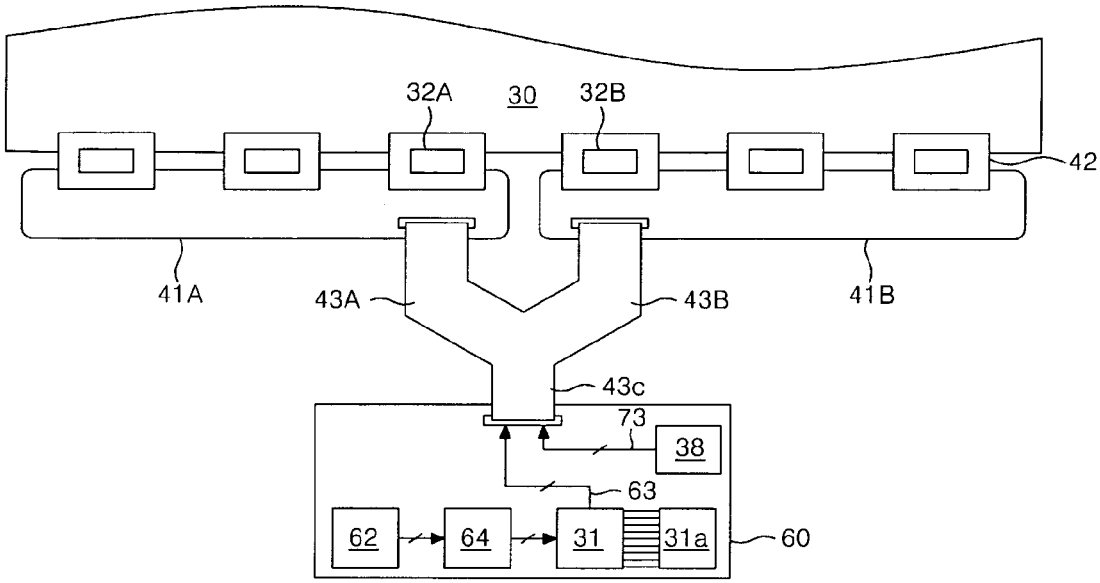
FIG. 32 is a diagram representing a connection configuration of an LCD device according to the seventh embodiment of the present invention.

FIG. 32 illustrates an assembled structure of the LCD panel 30, data driving circuits 32, and the timing controller 31 (see FIG. 5) according to the seventh embodiment of the present invention.

As shown in FIG. 32, the data driving circuit 32 includes plurality of first data ICs 32A and second data ICs 32B. The data ICs 32A and 32B are respectively mounted on the source COFs 42, respectively. The source COFs 42 can be replaced with the source TCPs (Tape Carrier Packages). The source COFs 42 are divided into two groups and are connected to the first and second source PCBs 41A and 41B, respectively. The input terminals of the source COFs 42 are electrically connected respectively to the output terminals of the first and second source PCBs 41A and 41B. The output terminals of the source COFs 42 are electrically connected to data pad, which are formed on the lower glass substrate of the LCD panel 30, via an ACF (anisotropic conductive film). The first and second source PCBs 41A and 41B each include bus lines to receive the digital video data RGBodd and RGBeven, bus lines to receive data timing control signals, and bus lines to receive driving voltages.

The input terminals of the first source PCB 41A are electrically connected to the system board 60 via the first output terminal 43A of the Y-shaped FFC (Flexible Flat Cable) and the common input terminal 43C of the Y-shaped FFC. The input terminals of the second source PCB 41B are electrically connected to the system board 60 via the second output terminal 43B of the Y-shaped FFC and the common input terminal 43C of the Y-shaped FFC.

The system board 60 may include such circuits as the timing controller 31, an EEPROM 31*a*, and a DC-DC converter 38 that generates driving voltages for the LCD panel 30. The system board 60 may also include the interface circuit 62 for receiving various video data from the external appliances. Further, the system board 60 may include the graphic processing circuit 64 having an analog-to-digital converter, a scaler for changing the resolution of the input data to be compatible with the resolution of the LCD panel 30, and an image processing circuit for signal interpolation and image processing. A detailed description of the structure and operation of the system board 60 and the components of the system board are provided above in connection with other embodiments of the present invention and are not repeated.

As shown in FIG. 32, the FFC having a Y-shape electrically connects the system board 60 to the first and second source PCBs 41A and 41B. The digital video data RGBodd, RGBeven and timing control signals generated by the timing controller 31, and the driving voltages generated by the DC-DC converter 38 are supplied to the common input terminal 43C of this Y-shaped FFC. Then, the digital video data RGBodd, RGBeven, timing control signals, and driving voltages are transmitted to the data ICs 32A and 32B, respectively, via the first and second output terminals 43A and 43B of this Y-shaped FFC.

Figure 33:
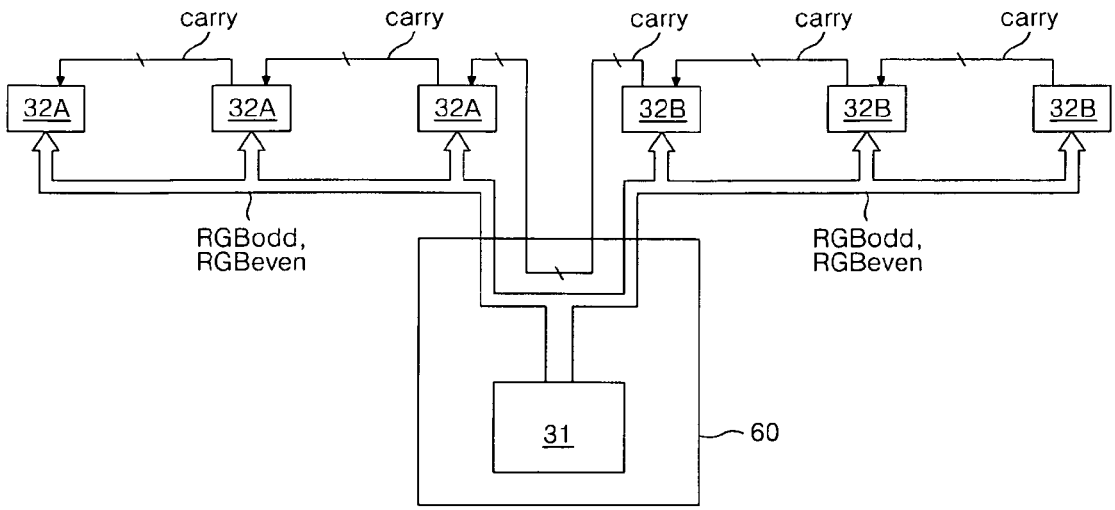
FIG. 33 shows an example signal transmission path in the LCD device shown in FIG. 32.

FIG. 33 shows a signal transmission path between the timing controller 31 and the data ICs 32A and 32B according to the seventh embodiment of the present invention.

As shown in FIG. 33, left data RGBodd, RGBeven, which have been modulated with the mini LVDS method, the RSDS method, or other appropriate methods by the timing controller 31, are transmitted to the first data ICs 32A. The first data ICs 32A are connected to the first source PCB 41A, which in turn is connected to the single output port 63 of the timing controller 31 via the first output terminal 43A and common input terminal 43C of the Y-shaped FFC. If the source COFs 42 are coupled to the data pads at the top edge of the LCD panel 30, the left data RGBodd, RGBeven represent the image to be displayed on the right half of the LCD panel 30. Alternatively, if the source COFs 42 are coupled to the data pads at the bottom edge of the LCD panel, the left data RGBodd, RGBeven represent the image to be displayed on the left half of the LCD panel 30.

On the other hand, right data RGBodd, RGBeven, which are also modulated with the mini LVDS method, the RSDS method, or other appropriate methods by the timing controller 31, are transmitted to the second data ICs 32B. The second data ICs 32B are connected to the second source PCB 41B, which in turn is connected to the single output port 63 of the timing controller 31 via the second output terminal 43B and the common input terminal 43C of the Y-shaped FFC. If the source COFs 42 are coupled to the data pads at the top edge of the LCD panel 30, the right data RGBodd, RGBeven represent the image to be displayed on the left half of the LCD panel 30. Alternatively, if the source COFs 42 are coupled to the data pads at the bottom edge of the LCD panel, the right data RGBodd, RGBeven represent the image to be displayed on the right half of the LCD panel 30.

The timing control signals generated from the timing controller 31 are also transmitted to the first data ICs 32A, connected to the first source PCB 41A, via the single output port 63 of the timing controller 31, the single input terminal 43C of the Y-shaped FFC, and the first output terminal 43A of the Y-shaped FFC. Also, the timing control signals are transmitted to the second data ICs 32B, connected to the second source PCB 41B, via the single output port 63 of the timing controller 31, the single input terminal 43C of the Y-shaped FFC, and the second output terminal 43B of the Y-shaped FFC.

The rightmost second data IC 32B samples the first data subsequent to the start pulse the number of times substantially equal to the number of its own output channels, as shown for example in FIGS. 10 and 11. The rightmost second data IC 32B then generates a carry signal that indicates a sampling timing of the next data and supplies it to the adjacent second data IC 32B. In the same manner, the carry signal is sequentially transmitted to the adjacent data ICs 32A, 32B. The carry signal is transmitted from the second source PCB 41B to the first source 41A via the second output terminal 43B of the Y-shaped FFC and the first output terminal 43A of the Y-shaped FFC. Alternatively, the data sampling direction of the data ICs 32A, 32B may be reversed. In this case, the carry signal is transmitted from the first source PCB 41A to the second source PCB 41B via the first output terminal 43A of the Y-shaped FFC and the second output terminal 43B of the Y-shaped FFC.

The driving voltages generated from the DC-DC converter 38 mounted on the system board 60 are transmitted to the first data ICs 32A, connected to the first source PCB 41A, via the output terminal 73 of DC-DC converter 38, the common input terminal 43C of the Y-shaped FFC, and the first output terminal 43A of the Y-shaped FFC. The driving voltages are also transmitted to the second data ICs 32B, connected to the second source PCB 41B, via the output terminal 73 of the DC-DC converter 38, the common input terminal 43C of the Y-shaped FFC, and the second output terminal 43B of the Y-shaped FFC.

Figure 34:
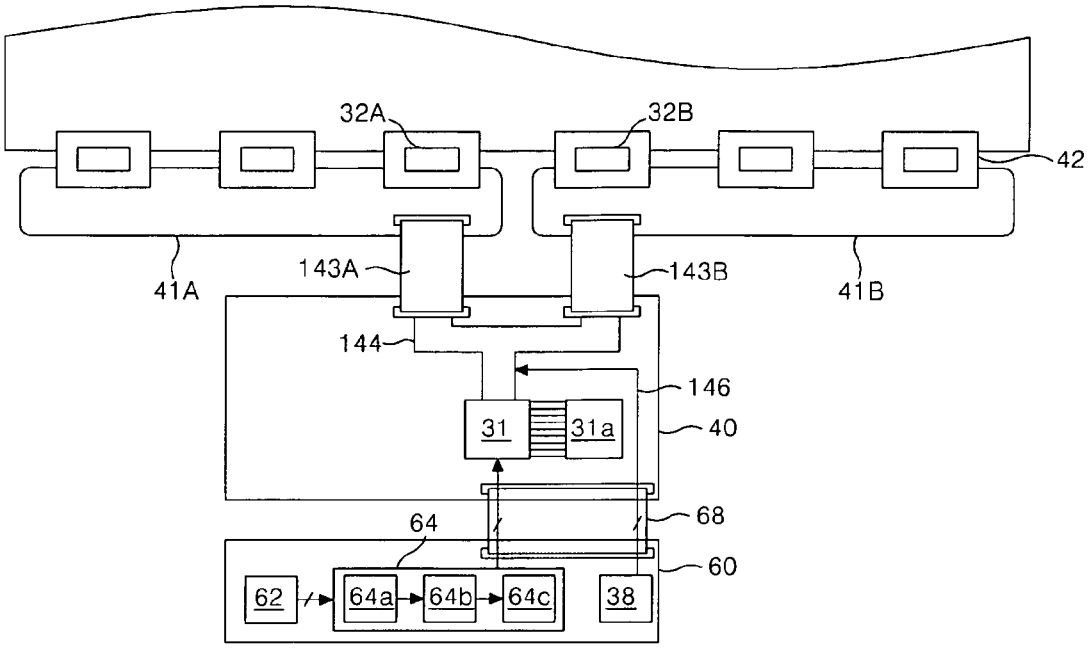
FIG. 34 is a diagram representing a connection configuration of an LCD device according to the eighth embodiment of the present invention.
Figure 35:
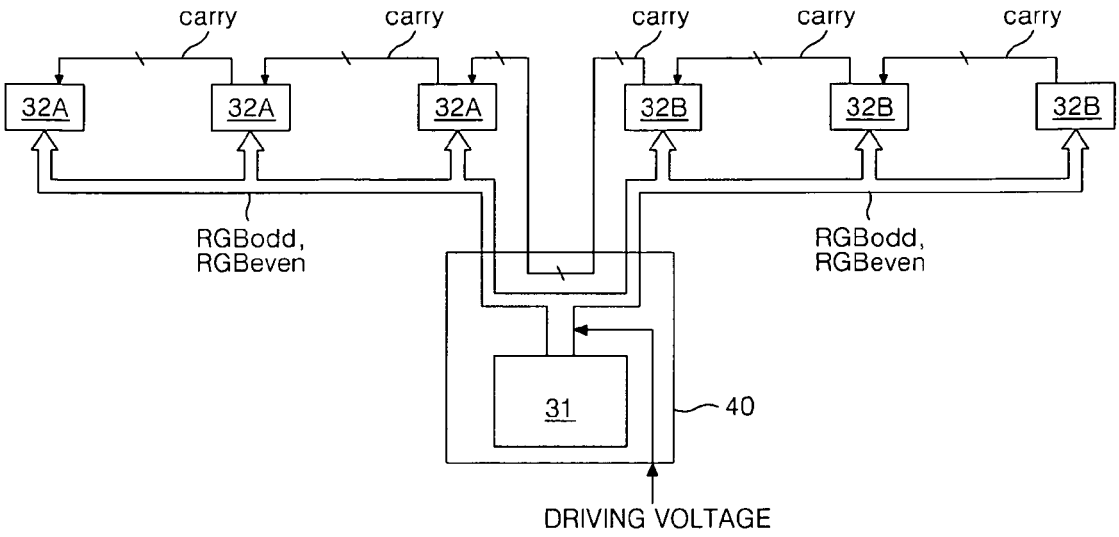
FIG. 35 shows an example signal transmission path in the LCD device shown in FIG. 34.

FIG. 34 shows an LCD device according to the eighth embodiment of the present invention. FIG. 35 shows an example signal transmission path in the LCD device shown in FIG. 34. The control PCB 40 includes signal wires 146 for transmitting the driving voltages generated by a DC-DC converter 38 to the first and second FFCs 143A and 143B. The system board 60 includes the interface circuit 62 for receiving various video data from the external appliances, the graphic processing circuit 64 for modifying the video data from the interface circuit 62 to be compliant with the LCD panel 30, and a DC-DC converter 38 for generating driving voltages for the LCD panel 30. The detailed description of the components provided on the control PCB 40 and system board 60 are provided above and are not repeated.

As described above, the LCD device according to one aspect of the present invention divides the source PCB into a plurality of smaller source PCBs. Further, since the timing controller employs a single output port, the timing controller has a smaller number of output pins, and the size of the control PCB may be reduced. In addition, the LCD device according to the present invention may remove one of the FFCs and instead employ the LOG lines formed in the LCD panel and dummy lines on COFs, thereby simplifying the connections between the control PCB and the source PCBs and reducing the number of parts needed to build the LCD device.

Further, the LCD device thereof according to another aspect of the present invention respectively connects compensation resistors to data ICs connected to the source PCB which receives the drive signals from the control PCB directly through an FFC. This reduces or prevents potential discrepancy between the gamma compensation voltages from the source PCB receiving the driving voltages directly through an FFC and those from the source PCB receiving the driving voltages via the LOG lines.

In addition, the dummy lines in the source COF or the source TCP for transmitting the drive voltages may be formed wider than the other dummy lines for transmitting the data timing control signals. Likewise, the LOG lines for transmitting the drive voltages may be formed wider than the other LOG lines for transmitting the data timing control signals. As a result, the drop in the drive voltages caused by the line resistance on the LOG lines can be minimized or substantially prevented such that the discrepancy in the gamma compensation voltages from different PCBs is reduced or prevented.

Also as explained above, in the LCD device according to another aspect of the present invention, the elements and functions of the control PCB are integrated into the system board. Further, the timing controller employs a single output port, thereby reducing the number of output pins of the timing controller and reducing the size of the system board. As a result, the cost of manufacturing LCD devices can be reduced, and the manufacturing time shortened. Further, the LCD devices may be made thinner than the related art devices.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display, comprising:

a display panel including a first group of data lines and second group of data lines, a plurality of gate lines crossing the first and second groups of data lines, and a plurality of picture cells arranged in a matrix;

a first source printed circuit board (PCB) coupled to first data integrated circuits (ICs) to supply a first data voltage to the first group of data lines;

a second source PCB coupled to second data ICs to supply a second data voltage to the second group of data lines;

a timing controller having an single output port configured to output a video data to both the first and second data ICs, and to output a timing control signal to control both the first and second data ICs; and a first connection cable coupling the single output port of the timing controller to at least one of the first and second source PCBs to transmit the video data and the timing control signal from the timing controller to the at least one of the first and second source PCBs, wherein the first data ICs and second data ICs are configured to generate the first and second data voltages, respectively, based on the video data and the timing control signal, wherein the timing controller is configured to receive an input video data at a first frequency and to output the video data at a second frequency that is substantially higher than the first frequency, and wherein the timing controller includes:

a two-port expansion part configured to divide the input video data into odd pixel data and even pixel data at a third frequency that is substantially lower than the first frequency, and a data modulator configured to modulate the odd and even pixel data from the two-port expansion part to decrease a swing width of the odd and even pixel data, and to output the video data in a modulated form at the second frequency.

2. The display according to claim 1, wherein the first connection cable couples the single output port of the timing controller to the first source PCB to transmit the video data and the timing control signal from the single output port of the timing controller to the first source PCB.

3. The display according to claim 2, further comprising a second connection cable coupling the single output port of the timing controller to the second source PCB to transmit the video data and the timing control signal from the single output port of the timing controller to the second source PCB.

4. The display according to claim 3, further comprising a control PCB, wherein the control PCB includes:

the timing controller; and connection lines coupling the single output port of the timing controller both to the first connection cable and to the second connection cable to transmit the video data and the timing control signal from the single output port of the timing controller to the first and second connection cables.

5. The display according to claim 4, wherein one of the connections lines and the first and second connection cables are also configured to transmit a carry signal between one of the first data ICs and one of the second data ICs.

6. The display according to claim 1, wherein the first connection cable couples the single output port of the timing controller to both the first and second source PCBs to transmit the video data and the timing control signal from the single output port of the timing controller to the first and second source PCBs.

7. The display according to claim 1, wherein the first connection cable is also configured to transmit a carry signal between one of the first data ICs and one of the second data ICs.

8. The display according to claim 1, wherein:

the first cable couples the single output port to only one of the first and second source PCBs to transmit the video data and the timing control signal from the single output port of the timing controller to the one of the first and second source PCBs; and the display panel includes lines on glass (LOGs) to couple the first source PCB to the second source PCB and to transmit the video data and the timing control signal from the one of the first and second source PCBs to the other of the first and second source PCBs.

9. The display according to claim 8, wherein one of the LOGs is configured to transmit a carry signal between one of the first data ICs and one of the second data ICs.

10. The display according to claim 1, further comprising:

a system board, wherein the system board includes:

an interface circuit configured to receive input data from an external source, a graphic processing circuit configured to output digital video data and timing signals to the timing controller based on the input data from the interface circuit, and a voltage source configured to generate a driving voltage to drive the display panel.

11. The display according to claim 10, wherein the system board further includes:

the timing controller; and a memory that supplies waveform option information of the timing control signal to the timing controller.

12. The display according to claim 10, wherein:

the graphic processing circuit includes:

an analog to digital converter to convert the input data from the interface circuit to digital input data;

a scaler configured to modulate the digital input data by adjusting the resolution of the digital input data and modulate the resolution adjusted digital input data to adjust at least one of the response characteristics and contrast of the display panel; and an image processor to generate a sync signal, a data enable signal, and a dot clock based on the modulated digital input data, and the timing controller generates the video data and the timing control signal based on one or more of the modulated digital input data, the sync signal, the data enable signal, and the dot clock.

13. The display according to claim 1, wherein the display comprises a liquid crystal display.

14. A liquid crystal display, comprising:

a liquid crystal display panel including a first group of data lines and a second group of data lines, a plurality of gate lines crossing the first and second groups of data lines, a plurality of liquid crystal cells arranged in a matrix, and lines on glass (LOGs);

a first source printed circuit board (PCB) coupled to first data integrated circuits (ICs) to supply first data voltages to the first group of data lines;

a second source PCB coupled to second data ICs to supply the second data voltages to the second group of data lines;

a timing controller configured to output video data and a timing control signal to the first source PCB;

a first resistor coupled to an input terminal of one of the first data ICs; and a second resistor coupled to an input terminal of one of the second data ICs, wherein the LOGs couple the first and second source PCBs to transmit the video data and the timing control signal from the first source PCB to the second source PCBs, wherein the first data ICs and second data ICs are configured to generate the first and second data voltages, respectively, based on the video data and the timing control signal, and wherein:

$$R_{TA}=(R_{TB}(R_{EQ}+R_{LOG}))/R_{EQ},$$

where $R_{TA}$ is a resistance value of the first resistor, $R_{TB}$ is a resistance value of the second resistor, $R_{EQ}$ is a resistance over the connection cable, and $R_{LOG}$ is a line resistance over one of the LOGs.

15. The liquid crystal display of claim 14, further comprising a connection cable coupling the timing controller to the first source PCB to transmit the video data and the timing control signal from the timing controller to the first source PCB.

16. The liquid crystal display of claim 15, further comprising:

a voltage source to supply a drive voltage to the liquid crystal panel, wherein the connection cable is further configured to transmit the drive voltage from the voltage source to the first source PCB, and wherein the LOGs are further configured to transmit the drive voltage from the first source PCB to the second source PCB.

17. The liquid crystal display of claim 16, wherein at least one of the first data ICs comprises:

a resistor string connected in series to divide the drive voltage to generate gamma compensation voltages; and a compensation resistor coupled in parallel to the resistor string, wherein the at least one of the first data ICs is configured to generate the first data voltages based on the gamma compensation voltages.

18. The liquid crystal display of claim 14, further comprising:

a power supply to generate a drive voltage for driving the liquid crystal display panel, wherein the LOGs are further configured to transmit the drive voltage from the first source PCB to the second source PCB.

19. The liquid crystal display of claim 18, wherein a first one of the LOGs has a smaller width than a second one of the LOGs.

20. The liquid crystal display of claim 19, wherein:

the first one of the LOGs is configured to transmit the timing control signal; and the second one of the LOGs is configured to transmit the driving voltage.

21. The liquid crystal display of claim 14, further comprising:

a first COF (chip on film) coupled to at least some of the first group of data lines on the liquid crystal display panel and to the first source PCB, the first COF comprising one of the first data ICs and first dummy lines; and a second COF coupled to at least some of the second group of data lines on the liquid crystal display panel and to the second source PCB, the second COF comprising one of the second data ICs and second dummy lines, wherein the first dummy lines are coupled to the first source PCB and to one end of the LOGs to transmit the timing control signal and the video data from the first source PCB to the LOGs, and wherein the second dummy lines are coupled to the second source PCB and to other end of the LOGs to transmit the timing control signal and the video data from the LOGs to the second source PCB.

22. The liquid crystal display of claim 14, further comprising:

a first TCP (tape carrier package) coupled to at least some of the first group of data lines on the liquid crystal display panel and to the first source PCB, the first TCP having one of the first ICs and first dummy lines; and a second TCP coupled to at least some of the second group of data lines on the liquid crystal display panel and to the second source PCB, the second TCP having one of the second ICs and second dummy lines, wherein the first dummy lines are coupled to the first source PCB and to one end of the LOGs to transmit the timing control signal and the video data from the first source PCB to the LOGs, and wherein the second dummy lines are coupled to the second source PCB and to other end of the LOGs to transmit the timing control signal and the video data from the LOGs to the second source PCB.

23. The liquid crystal display of claim 14, wherein one of the LOGs is configured to transmit a carry signal between one of the first data ICs and one of the second data ICs.

24. A liquid crystal display, comprising:

a liquid crystal display panel including a first group of data lines and second group of data lines, a plurality of gate lines crossing the first and second groups of data lines, and a plurality of liquid crystal cells arranged in a matrix;

a first source printed circuit board (PCB) coupled to first data integrated circuits (ICs) to supply first data voltages to the first group of data lines;

a second source PCB coupled to second data ICs to supply second data voltages to the second group of data lines; and a timing controller configured to output video data to both the first and second data ICs and to output a timing control signal to control both the first and second data ICs, wherein the timing controller is configured to receive an input video data at a first frequency and to output the video data at a second frequency that is substantially higher than the first frequency, wherein the first data ICs and second data ICs are configured to generate the first and second data voltages, respectively, based on the video data and the timing control signal, and wherein the timing controller includes:

a two-port expansion part configured to divide the input video data into odd pixel data and even pixel data at a third frequency that is substantially lower than the first frequency, and a data modulator configured to modulate the odd and even pixel data from the two-port expansion part to decrease a swing width of the odd and even pixel data, and to output the video data in a modulated form at the second frequency.

25. The liquid crystal display according to claim 24, wherein the timing controller includes an single output port, the single output port being configured to output the video data serially to output the video data for the first group of data lines first and then for the second group of data lines.

26. The liquid crystal display device according to claim 24, wherein the data modulator is configured to modulate the odd and even pixel data by employing one of a mini LVDS (log voltage differential signaling) method and an RSDS (reduced swing differential signaling) method.

27. The liquid crystal display device according to claim 26, wherein the first and second data ICs each include a data restoring part to demodulate the video data received from the data modulator in the modulated form.

* * * * *